US005151075A

United States Patent [19]

Beaulleu et al.

[11] Patent Number: 5,151,075

[45] Date of Patent: Sep. 29, 1992

[54] CARTON FOLDING APPARATUS

[75] Inventors: Norman R. Beaulleu, Nashua, N.H.; David E. Clark, Shreveport, La.; Arthur B. Clingman, III, Shreveport, La.; Richard F. Jeffrey, Shreveport, La.; James A. Mahlum, Stonewall, La.; Larry E. Reeves, West Monroe, La.

[73] Assignee: J & L Industries, Inc., Keithville, La.

[21] Appl. No.: 608,910

[22] Filed: Nov. 5, 1990

[51] Int. Cl.[5] ..... B31B 1/06

[52] U.S. Cl. ..... 493/179; 493/178; 493/182; 493/183; 271/144; 271/171

[58] Field of Search ..... 493/177, 178, 179, 180, 493/181, 182, 183; 271/34, 35, 137, 138, 144, 165, 167, 169, 171; 414/788.9, 789, 795.7, 797.4, 797.6

[56] References Cited

U.S. PATENT DOCUMENTS

| | | | |
|---|---|---|---|
| 1,555,378 | 9/1925 | Labombarde | 493/179 X |
| 1,903,243 | 3/1933 | Peck | 495/177 X |
| 2,583,713 | 1/1952 | Shields | 271/144 X |
| 2,589,944 | 3/1952 | Labombarde | 493/179 |
| 2,911,889 | 11/1959 | Welsh | 493/177 |
| 3,122,242 | 2/1964 | Lopez et al. | 414/788.9 |
| 3,138,076 | 6/1964 | Lobdell | 493/183 X |
| 3,357,700 | 12/1967 | Bradicick | 271/171 X |
| 3,797,370 | 3/1974 | Sawada | 493/182 X |
| 4,544,368 | 10/1985 | Labombarde | 493/183 X |
| 4,715,846 | 12/1987 | Zak | 493/10 |
| 4,897,804 | 10/1987 | Pollick | 271/171 X |

FOREIGN PATENT DOCUMENTS

| | | | |
|---|---|---|---|
| 0041325 | 2/1988 | Japan | 271/171 |

OTHER PUBLICATIONS

Post CX-2074 Specialty folder/Gluer brochure, Post, no date.

Post Straightline Gluers, Post, no date.

Tanabe OCG-EF Model 1700, 2200, 2700 brochure, Tanabe Machinery Co., Ltd., Tokyo, Japan, no date.

Domino 85-M, 110-M folder-Gluers brochure, Bobst SA, Lausanne, Switzerland, no date.

*Primary Examiner*—Bruce M. Kisliuk
*Assistant Examiner*—John A. Marlott
*Attorney, Agent, or Firm*—John M. Harrison

[57] ABSTRACT

A carton folding apparatus which is characterized by multiple folder/gluer modules, including a feed module for receiving and delivering unfolded cartons, prefold-/fold, fold and final fold modules for effecting specified folding and gluing operations, a delivery module for completing the folding operations and further including a stacker unit for receiving and stacking the folded and glued cartons. Each of the folder/gluer modules is capable of being removed from the apparatus line and is characterized by separate, independently driven upper and lower belt feed mechanisms for driving the cartons through that module. The feed module includes adjustable upper and lower feed assemblies and the remaining prefold/fold, fold, delivery and final fold modules include upper and lower carriages, which upper carriages may be adjusted upwardly with respect to the feed assembly and bottom carriages, respectively, and both carriages in the prefold/fold, fold, delivery and final fold modules are laterally adjustable to accommodate cartons of various width. While the respective belts in each of the folder/gluer modules are independently driven, all belt drive motors are synchronized to insure that the belts operate at the same speed. The belt-carrying mechanisms in all of the folder/gluer modules are designed to facilitate optimum belt replacement without the necessity of dismantling the carrying mechanisms.

32 Claims, 11 Drawing Sheets

CARTON FOLDING APPARATUS

BACKGROUND OF THE INVENTION

1. Field of the Invention

This invention relates to box, blank or carton folding apparatus and more particularly, to a carton folding apparatus which is modular in design, the folding and gluing (folder/gluer) modules of which are capable of lateral and vertical adjustment, as well as optimum belt removal and replacement. Each of the folder/gluer modules is further characterized by at least one drive motor for driving the belt system or systems in that module and these drive motors are synchronized to insure a uniform belt speed throughout the prefold-/fold, fold and delivery modes. All folder/gluer modules are constructed such that the upper portion in each case may be raised with respect to the lower portion for clearing carton jams and cleaning purposes and both the upper and lower segments may be adjusted laterally to accommodate cartons or boxes of selected width. A pneumatically-equipped stacker unit is provided for receiving and stacking the folded and glued cartons delivered from the folder/gluer.

Some of the problems which are inherent in the design of conventional carton folding devices, or "folder/gluers", are the difficulty of replacing belts without disassembling the apparatus; cleaning and clearing carton jams between belts and roller systems; adjusting the conveyor system to accommodate cartons, boxes or "blanks" of various width; and the difficulty or impossibility of substituting one segment of the apparatus for another or removing a portion of the machine when specific folding and/or gluing operations are required. The carton folding apparatus of this invention solves these problems by providing a split modular design which allows substitution of various versatile, unconnected modules to achieve the desired folding and gluing functions and facilitates both vertical and lateral adjustment, as well as optimum machine accessibility for cleaning, maintenance and quick and easy replacement of belts. The carton folding apparatus also incorporates a state-of-the-art electronic control system for insuring that the belts in each of the folding and gluing modules are synchronized at a desired uniform speed.

2. Description of the Prior Art

Various "folder/gluers" are known in the art. The "Domino 85- M and Domino 110-M" Folder Gluers, built by Bobst Group, Inc. of Roseland, N.J., are medium size folder-gluer machines utilizing modular concepts. The CX-2074 Specialty Folder/Gluer is marketed by Post Machinery Company, Inc. of Portsmouth, N.H., and is designed to operate both mechanically and by computer. The "Tanabe OCG-EF" box folding device is marketed by Tanabe Machinery Company, Ltd. of Tokyo, Japan and features micro-computer control of most machine functions. U.S. Pat. No. 4,715,846, dated Dec. 29, 1987, to Chet Zak, details a "Trailing Panel Folder" for use in a blank folding machine. The system includes a rotatable shaft mounted below the path of the blank and transverse to this path. A motor is connected to drive the shaft and an arm assembly is mounted on the shaft and includes an arm extending away from the shaft and a folding head for folding the trailing panel of a blank. An encoder is interconnected with the drive to provide a pulsed output which is related to the velocity at which the blanks are moving along the path and a blank sensor provides a trailing edge signal when the trailing edge of the sensed blank leaves the location. A programmable motor controller moves the arm assembly to a predetermined start position in which the folding head is disposed upstream of the shaft and effects the following: causes the folding head to move to an "up" position, wherein it overlies the folded trailing panel at a speed sufficiently fast to overtake and fold the panel; causes the folding head to dwell in the "up" position; and causes the arm to move to a "start" position after the folded panel has moved from under the folding head.

It is an object of this invention to provide a new and improved box, blank, and carton folding apparatus which is modular in design and includes vertically adjustable upper assemblies and horizontally adjustable upper and lower assemblies for optimum machine accessibility in cleaning box, blank or carton jams and cleaning and accommodating boxes, blanks and cartons of selected width and design, respectively.

Another object of this invention is to provide a carton folding apparatus which incorporates a modular, multiple belt drive and support conveying system that facilitates quick and easy replacement of individual belts without the necessity of disassembling the belt-support and/or drive apparatus.

Yet another object of this invention is to provide a new and improved carton folding apparatus, the folder/gluer portion of which is characterized by a feed module, a prefold/fold module, a fold module, a final fold module and a delivery module operating in linear, belt-aligned cooperation, which modules are adjustable vertically and horizontally to clear carton jams and accommodate cartons of various width, respectively.

A still further object of the invention is to provide a carton folding apparatus which is characterized by a horizontally-split, modular, folder/gluer having feed, prefold/fold, fold, final fold, delivery units, as well as a stacker unit, which folder/gluer units may be interchanged or removed from the apparatus line to effect folding and/or gluing and stacking functions of substantially any desired nature.

Still another object of this invention is to provide a carton folding apparatus having modular folder/gluer feed, prefold/fold, fold, final fold and delivery systems that are both vertically and horizontally adjustable for clearing carton jams, cleaning and accommodating cartons of selected width and thickness, the feed module having a horizontally and vertically-adjustable upper feed assembly and the prefold/fold, fold, final fold and delivery modules each having vertically and horizontally adjustable upper carriages and horizontally adjustable lower carriages and further including a stacker unit which is further characterized by pneumatic operation.

SUMMARY OF THE INVENTION

These and other objects of this invention are provided in a new and improved modular carton folding apparatus characterized by a folder/gluer segment having feed, prefold/fold, fold, final fold and delivery modules arranged in belt-aligned, linear conveyor configuration for successively folding and gluing spaced cartons, each of which modules is horizontally split to facilitate vertical adjustment for optimum machine accessibility in clearing carton jams, cleaning and maintenance. Horizontal adjustment of the synchronized, belt-driving motors is also facilitated in these modules to accommodate cartons of various width and the belt mount systems are designed to allow individual belt replacement without disassembling the systems. A pneumatically operated stacker unit is designed to receive and stack the folded and glued cartons for delivery.

BRIEF DESCRIPTION OF THE DRAWINGS

The invention will be better understood by reference to the accompanying drawings, wherein:

FIG. 30 is a schematic diagram of a typical motor control system.

DESCRIPTION OF THE PREFERRED EMBODIMENTS

Figures 1A, 3A:
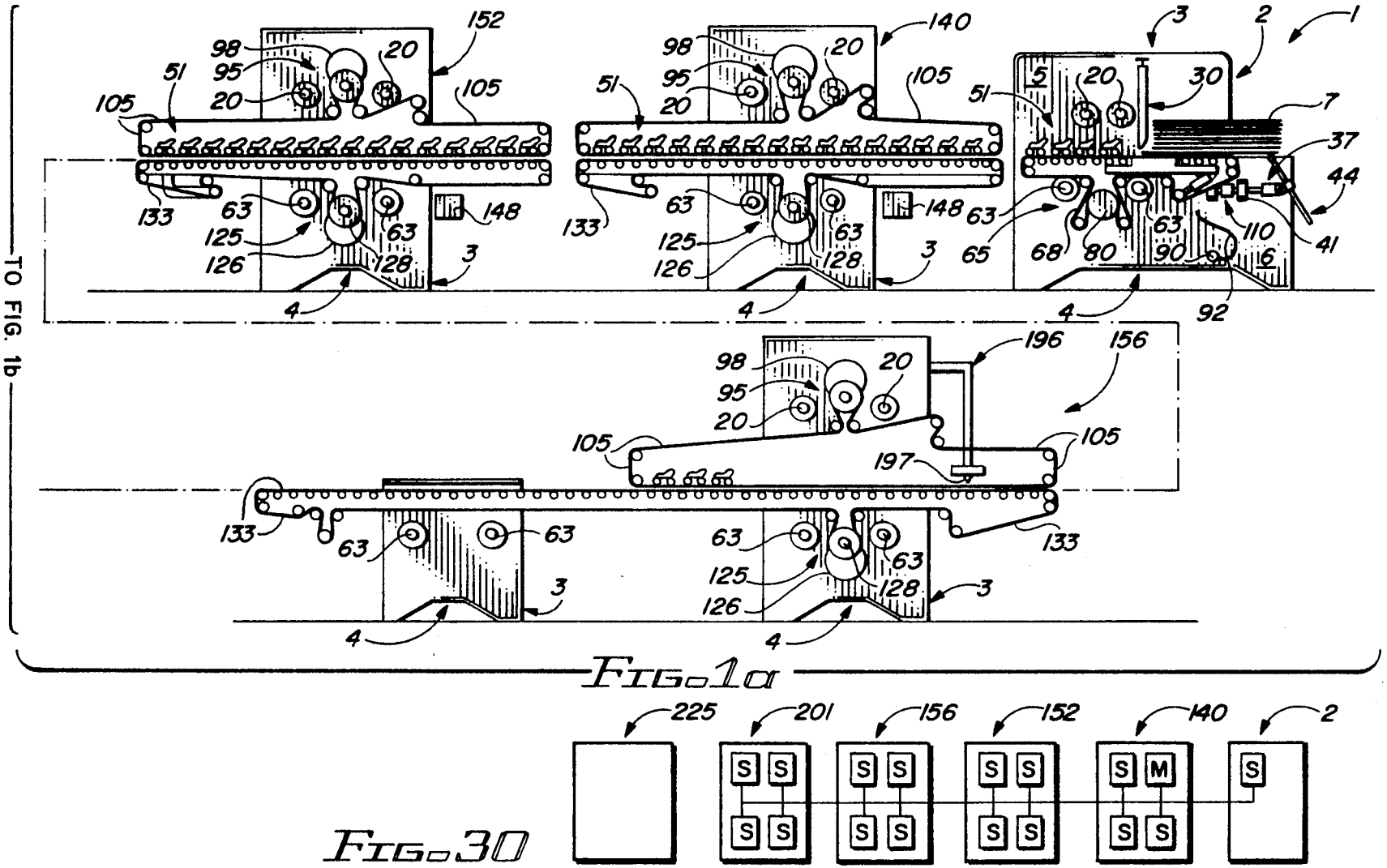
FIGS. 1*a*–1*b* are a side sectional view of a preferred embodiment of the carton folding apparatus of this invention.
Figure 1B:
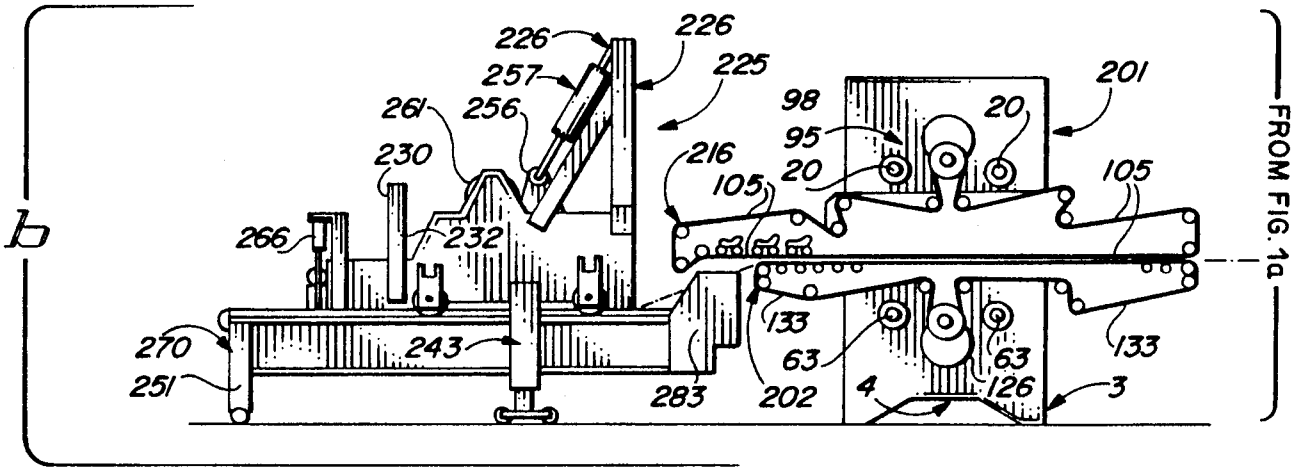
Figure 2B:
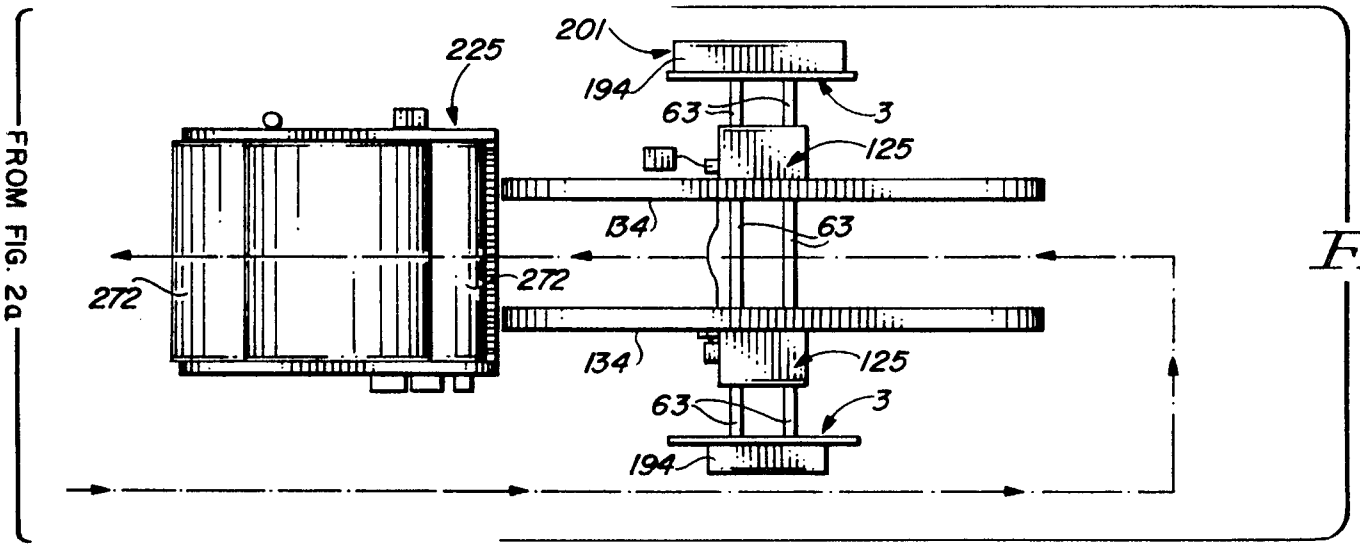
FIGS. 2*a*–2*b* are a top view of the lower carriage and roller systems of the feed, prefold/fold, fold, final fold and delivery modules and the stacker unit.
Figure 2A:
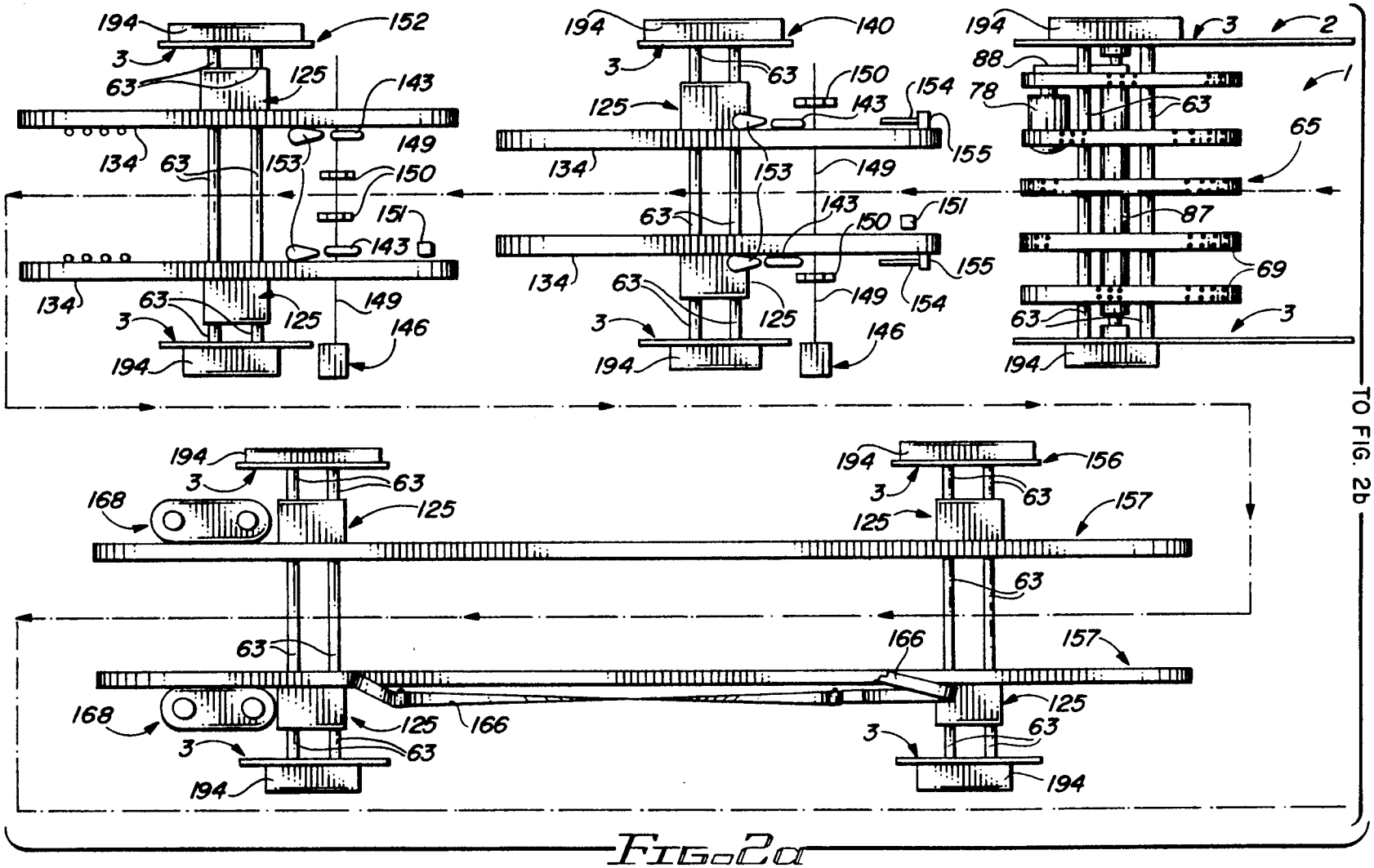

Referring initially to FIGS. 1 and 2 of the drawings, the carton folding apparatus of this invention is generally illustrated by reference numeral 1. The carton folding apparatus 1 is characterized by a feed module 2, for receiving and delivering unfolded cartons 7 of selected size, a prefold/fold module 140 for receiving the cartons 7 from the feed module and effecting certain prefold/fold operations, a fold module 152 for receiving the prefold/fold cartons 7 from the prefold/fold module 140 and effecting selected folding operations, a final fold module 156, which receives the cartons 7 from the fold module 152 and effects additional folding and gluing operations, a delivery module 201 for receiving the cartons 7 from the final fold module 156 and executing other folding operations and a stacker unit 225, which receives the cartons 7 from the delivery module 201 and stacks the cartons 7 in lapped configuration for traveling through the compressed section of the stacker, thus allowing the glued surfaces to be compressed together while the glue is setting.

Figure 3:
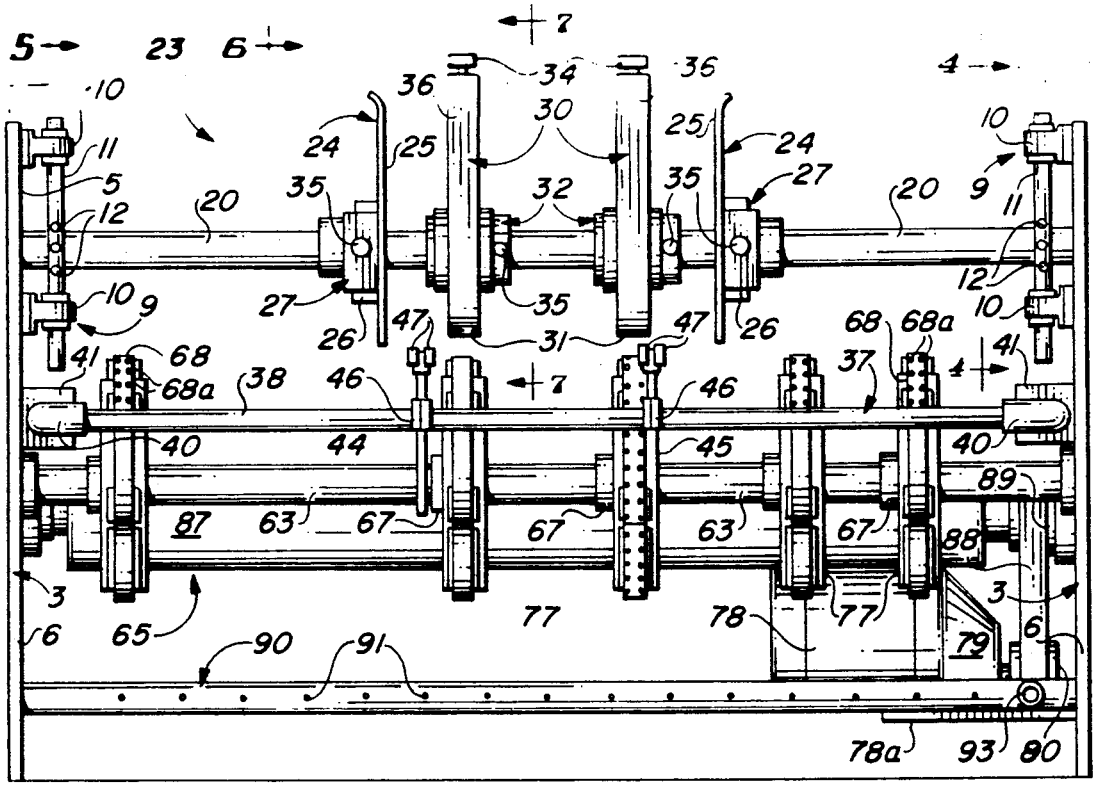
FIG. 3 is a front view of the feed module component of the carton folding apparatus illustrated in FIG. 1.
Figure 4:
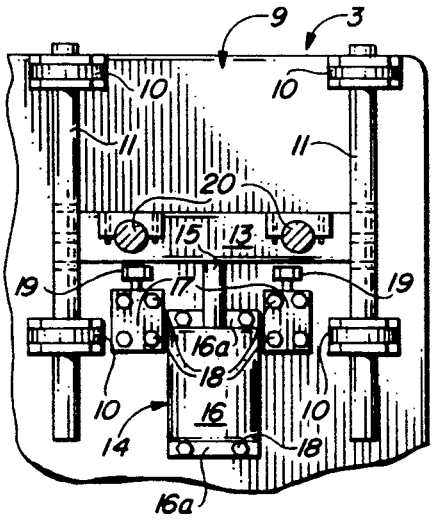
FIG. 4 is an enlarged sectional view taken along line 4—4 of the guide rod mount assembly component of the feed module illustrated in FIG. 3.
Figure 5:
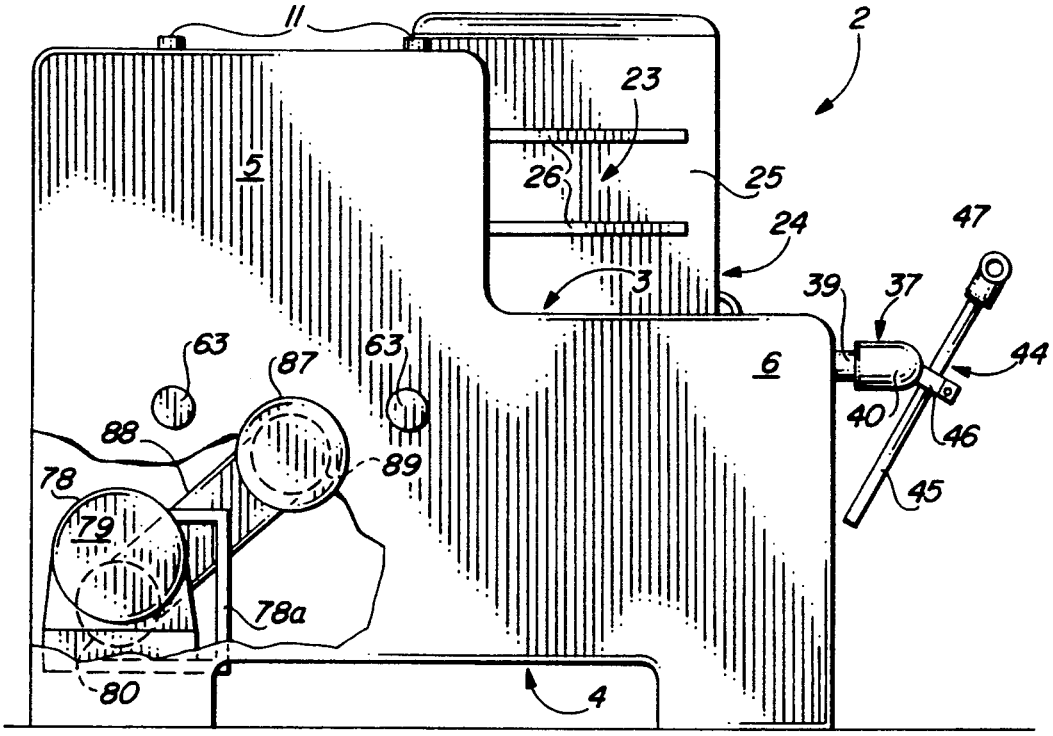
FIG. 5 is a left side view, partially in section, of the feed module illustrated in FIG. 3.
Figure 6:
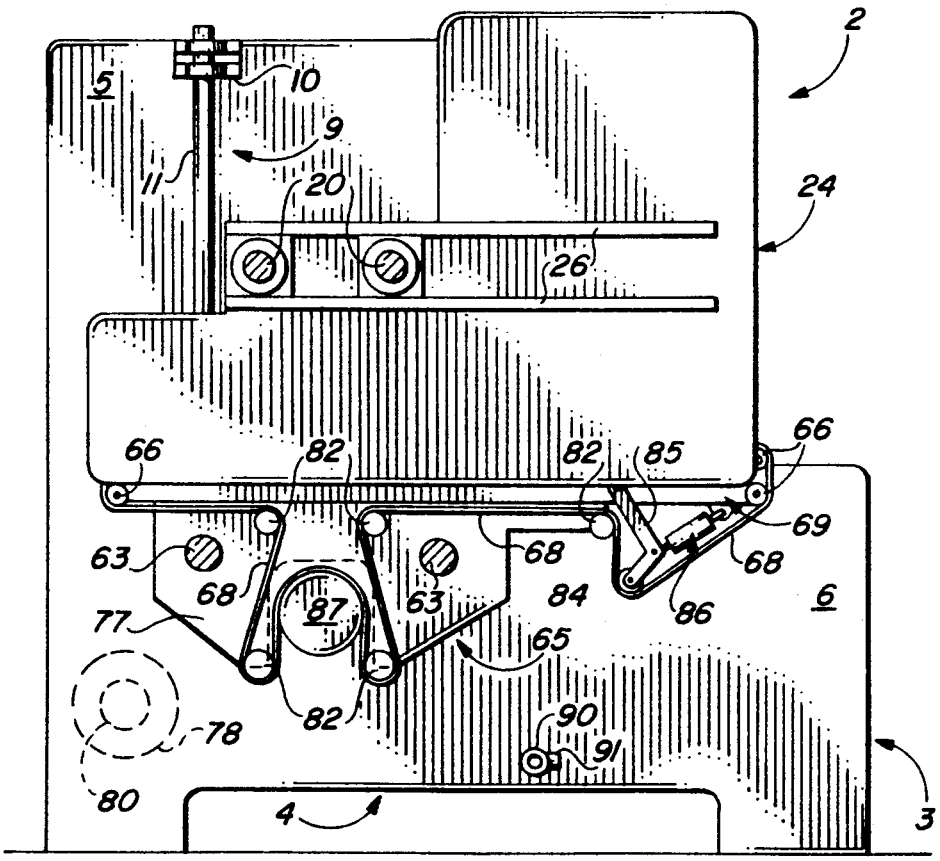
FIG. 6 is a sectional view taken along line 6—6 of the feed module illustrated in FIG. 3.

Referring now to FIGS. 1–9 of the drawings, the feed module 2 is further characterized by a pair of spaced, upward-standing side panels 3, each having an equipment slot 4 at the bottom thereof and shaped to define a top extension 5 and a front extension 6, as particularly illustrated in FIG. 5. A guide rod mount assembly 9 is secured to the inside of each of the side panels 3 in spaced, facing relationship and includes four vertical guide rod bearings 10 positioned in vertically spaced sets of two, as further illustrated in FIG. 4. The parallel sets of two vertical guide rod bearings 10 each receive a vertical guide rod 11 in vertical, slidably adjustable relationship and a horizontal guide rod mount 13 spans each set of the spaced vertical guide rods 11 for mounting a pair of upper horizontal guide rods 20 in parallel, horizontally-spaced relationship. In a preferred embodiment of the invention the horizontal guide rod mount 13 is attached to the spaced vertical guide rods 11 by means of bolts (not illustrated) which extend through selected ones of the vertically-spaced guide rod adjusting holes 12, located in the vertical guide rods 11, for vertical adjustment purposes. A lift cylinder 14 is positioned beneath each horizontal guide rod mount 13 and between the lower portions of the vertical guide rods 11 and the lift cylinder 14 is further characterized by a cylinder housing 16, which receives a cylinder piston 15 in extending relationship. The extending end of the cylinder piston 15 is mounted on the horizontal guide rod mount 13 with suitable fasteners (not illustrated), for raising and lowering the horizontal guide rod mount 13, upper horizontal guide rods 20 and vertical guide rods 11 in concert with respect to the fixed vertical guide rod bearings 10. Two adjustable stop mount blocks 17 are attached to each side panel 3 by means of mount bolts 18, and receive threaded adjusting bolts 19, respectively, for adjustably arresting the downward movement of the horizontal guide rod mounts 13 at a desired point.

Figure 7:
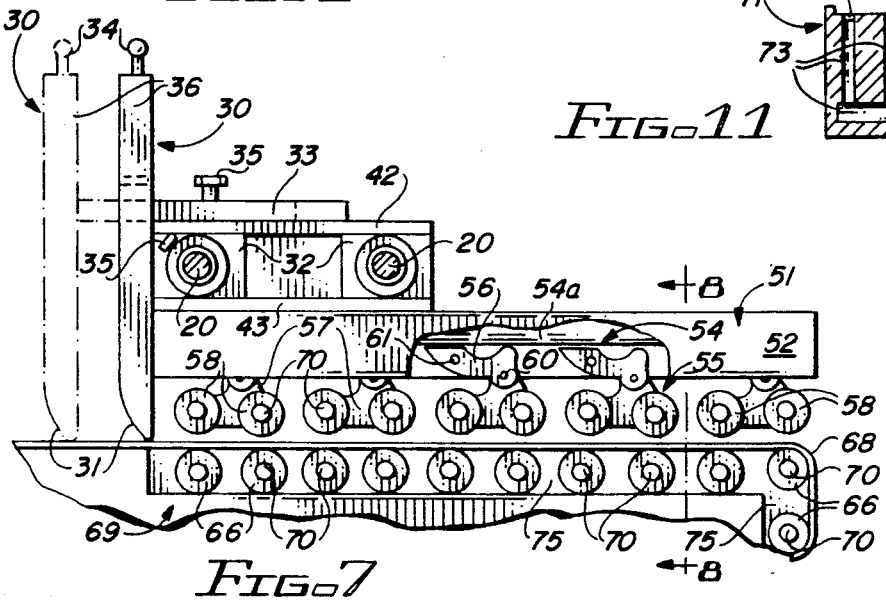
FIG. 7 is a sectional view taken along line 7—7 of the feed module illustrated in FIG. 3.
Figure 9:
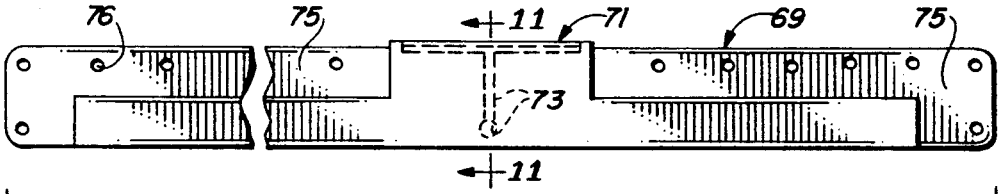
FIG. 9 is a side view of a vacuum plate element of the feed module illustrated in FIGS. 3–7.
Figure 10:
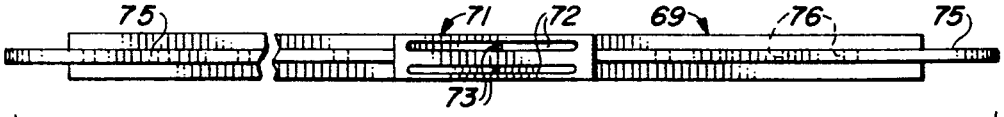
FIG. 10 is a top view of the vacuum plate illustrated in FIG. 9.

Referring again to FIGS. 3 and 5-7, an upper feed assembly is generally illustrated by reference numeral 23 and includes a pair of upward-standing carton guides 24, each characterized by a guide plate 25, having a curved top edge and a pair of parallel horizontal plates struts 26 located on the outside of the guide plate 25. Each of the carton guides 24 is provided with a pair of guide bearings 27 which mount the carton guides 24 in sliding, adjustable relationship on the upper horizontal guide rods 20, to facilitate adjustment of the carton guides 24 closer to or farther away from each other and accommodate the cartons 7 of various width. A pair of feed gates 30 are also mounted in spaced, slidable relationship on the upper horizontal guide rods 20 by means of corresponding gate bearings 32. Each of the feed gates 30 is characterized by a vertical gate post 36 having gate grip 34 at the top thereof and a gate curvature 31 at the lower end thereof, as illustrated in FIG. 7, in order to guide the respective unfolded cartons 7, stacked between the carton guides 24, into the feed module 2, as hereinafter further described. A gate bar 33 extends from the gate post 36 rearwardly and is slidably mounted on the top mount plate 42, capping the gate bearings 32. A bottom bearing plate 43 covers the bottom of the gate bearings 32. Adjusting knobs 35 are provided on the guide bearings 27 and gate bearings 32, respectively, to facilitate locking the carton guides 24 and the feed gates 30 in a selected horizontal position on the upper horizontal guide rods 20 and releasing the carton guides 24 and feed gates 30 for slidable adjusted disposition on the upper horizontal guide rods 20. The feed gates 30 also extend longitudinally in adjustable fashion by manipulation of additional adjusting knobs 35, as illustrated in phantom in FIG. 7. The upper carriage roller assemblies 51, also illustrated in FIG. 7, are connected to the respective feed gates 30 and therefore move laterally along the upper horizontal guide rods 20 with the feed gates 30, for adjustment purposes, as hereinafter further described.

Referring now to FIGS. 1 and 3-7 of the drawings, the cow-catcher cross-member 38 of a horizontally oriented cow-catcher 37 extends across the front portion of the front extensions 6 of the side panels 3 and the ends of the cow-catcher cross-member 38 are connected to spaced, parallel cow-catcher legs 39, by means of a pair of cow-catcher elbows 40. The cow-catcher legs 39 extend into a pair of spaced cow-catcher mounts 41, which are attached to the insides of the side panels 3 in sliding relationship for adjustment of the cow-catcher 37. As illustrated in FIG. 1, a clam shell lock 110 is fitted on each of the cow-catcher legs 39 between the cow-catcher mounts 41, for manually extending the cow-catcher cross-member 38 longitudinally outwardly or inwardly with respect to the side panels 3, as hereinafter more particularly described. A set of carton supports 44 each include an elongated carton support rod 45, projecting through a support rod clamp 46, which is secured to the cow-catcher cross-member 38 in pivoting and slidably-adjustable relationship. A pair of support rod rollers 47 terminate the top end of each of the carton support rods 45 for engaging the trailing edges of the cartons 7 and elevating the cartons 7 in angular relationship, such that the leading edges of the bottom cartons 7 are seated against the respective gate curvatures 31 of the feed gates 30, for feeding through the feed module 2, as further hereinafter described. Clamp levers not illustrated are provided on each of the support rod clamps 46 to facilitate horizontal, pivotal and slidable adjustment of the carton support rods 45 with respect to the cow-catcher cross-member 38.

Figure 8:
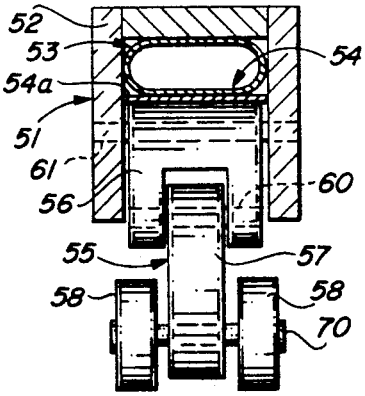
FIG. 8 is an enlarged sectional view taken along line 8—8 of the feed module illustrated in FIG. 7.
Figure 11:
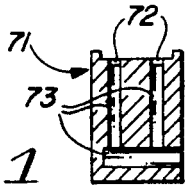
FIG. 11 is a sectional view taken along line 10—10 of the vacuum plate illustrated in FIG. 9.

A pair of upper carriage roller assemblies 51 are provided in spaced relationship in the upper feed assembly 23, one of which upper carriage roller assemblies 51 is illustrated in FIGS. 7 and 8 and is characterized by a roller assembly frame 52, provided with an internal tube chamber 53, as illustrated in FIG. 8. The tube chamber 53 encloses an elongated tube 54, which may be inflatable in the nature of an inner tube or constructed of a solid, resilient foam material such as foam rubber, or the like. In a most preferred embodiment of the invention a thin, flat plastic tube buffer strip **54*a*, located on the underside of the tube 54 in the tube chamber 53, is further illustrated in FIG. 8. Multiple roller trolleys 55 are disposed in linear, spaced relationship beneath each roller assembly frame 52 and the trolley bracket 56 element of each of the roller trolleys 55 extends into the roller assembly frame 52 and is pivotally mounted therein by means of a frame pin 61, illustrated in phantom in FIG. 8. A roller bracket 57 extends into a bifurcation shaped in each of the respective trolley brackets 56, where it is pinned in pivotal relationship by a bracket pin 60, also illustrated in phantom in FIG. 8. Four upper carriage rollers 58 are, in turn, rotatably mounted by means of separate roller pins 70, to the lower portion of the roller brackets 57, respectively, as further illustrated in FIG. 7. Accordingly, it will be appreciated that each of the roller trolleys 55 are free to pivot individually on the frame pin 61, respectively, with respect to the roller assembly frame 52. Furthermore, each of the roller brackets 57, as well as the upper carriage rollers 58 mounted thereon, are free to pivot in concert on the bracket pins 60**, respectively, for a purpose which will be further hereinafter described.

Referring against to FIGS. 1, 3, 5, 6 and 9-11, a pair of lower horizontal guide rods 63 are disposed between the respective side panels 3 in spaced, horizontally-disposed relationship for receiving a lower feed assembly 65. The lower feed assembly 65 is characterized by multiple feed belt rollers 66, mounted in spaced relationship on the vertically-oriented roller mount bars 75 of corresponding vacuum plate frames 69, in the respective vacuum plates 71. The feed belt rollers 66 are mounted in pairs on roller pins 70, extending through spaced bar openings 76, located in each roller mount bar 75. Each of the vacuum plate frames 69 is further mounted on a belt roller frame 77, having two frame bearings 67, mounted on the lower horizontal guide rods 63 and allowing horizontal adjustment of the respective vacuum plate frames 69 and belt roller frames 77 between the side panels 3 of the feed module 2. A vacuum plate 71 is located on the top of the respective vacuum plate frame 69, for receiving a corresponding feed belt 68, provided with spaced belt perforations **68*a*, and extending over the feed belt rollers 66. The vacuum plate 71 is further provided with spaced, elongated vacuum plate slots 72, which communicate with corresponding vacuum apertures 73 for connecting to vacuum lines 92, one of which is illustrated in FIG. 1, that extend between the respective vacuum plates 71 and a vacuum manifold 90, located beneath and forward of the lower horizontal guide rods 63. The vacuum lines 92 are connected to corresponding manifold nipples 91, projecting in spaced relationship from the vacuum manifold 90 and the vacuum manifold 90 is further provided with a vacuum pump line 93, which connects to a vacuum pump (not illustrated) for pulling a vacuum on the vacuum manifold 90 and the respective vacuum plate slots 72 in the vacuum plates 71. The respective feed belts 68 are each looped around corresponding feed belt rollers 66, a feed belt drum 87 and around feed belt idler pulleys 82, as well as feed belt tensioning pulleys 84, the latter of which are rotatably mounted on a corresponding belt roller frame 77. The feed belts 68 are driven in concert by a feed belt drive motor 78, mounted on a mount plate 78***a*, illustrated in FIG. 3, and connected to the feed belt drum 87 in driving relationship, as hereinafter further described. Accordingly, it will be appreciated by those skilled in the art that as each feed belt 68 is driven by the feed belt drum 87 and traverses a corresponding vacuum plate 71, the belt perforations 68*a* correspond to the vacuum plate slots 72 and the cartons which are stacked on top of the feed belts 68 are caused to adhere one-by-one to the feed belts 68 by operation of the vacuum to effect the bottom-load carton feeding operation.

As indicated above, and referring again to FIGS. 3, 5 and 6, the lower feed assembly 65 shown in FIG. 6 further includes a feed belt drive motor 78, attached to a side panel 3 by means of a mount plate 78*a* and a feed motor gearbox 69 is attached to the shaft (not illustrated) of the feed belt drive motor 78. A feed motor drive pulley 80 (illustrated in phantom) is secured to the shaft (not illustrated) of the feed motor gearbox 79 and receives a feed drive belt 8, which feed drive belt 88 is connected to a drum pulley 89 (also illustrated in phantom) secured to the feed belt drum 87. The respective feed belts 68 are fitted over the feed belt drum 87 in spaced relationship and over the series of feed belt idler rollers 82, as heretofore described. Feed belt tension cylinders 86 are each attached to a tensioning pulley bar 85, secured to the corresponding vacuum plate frame 69, each carrying a feed belt tensioning roller 84, for applying a selected degree of tension in the respective feed belts 68, as further hereinafter described.

Figure 13:
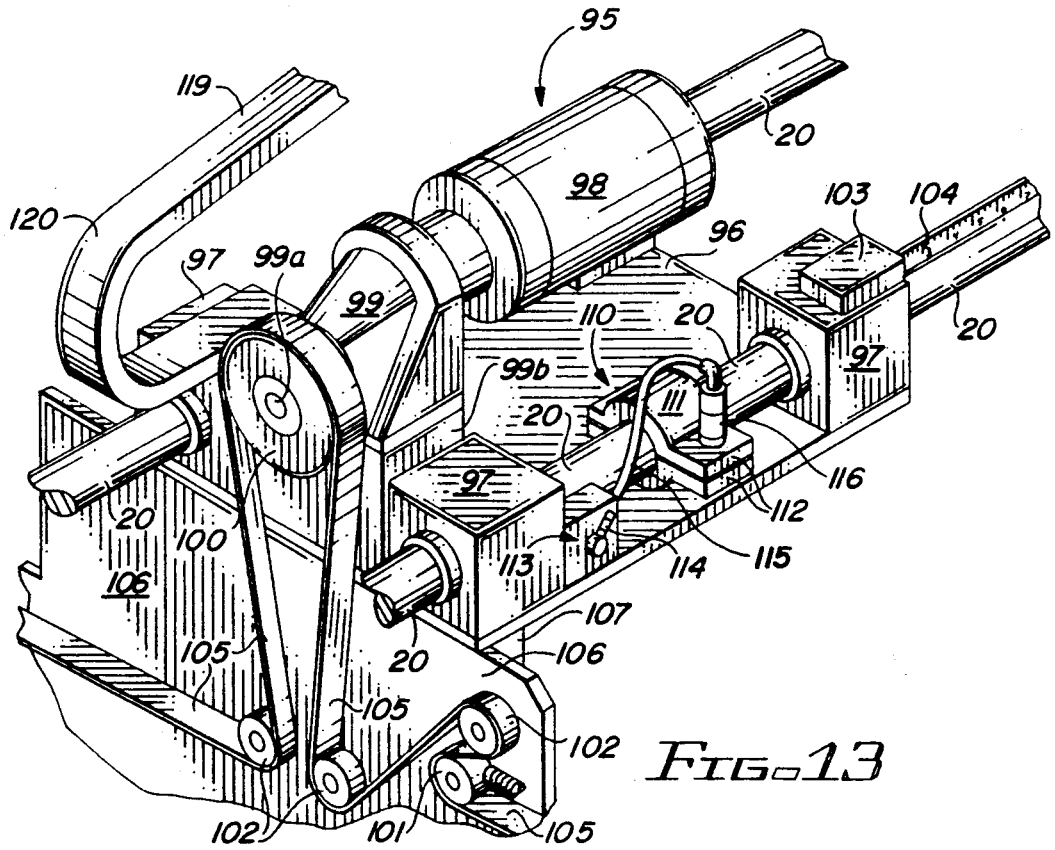
FIG. 13 is a perspective view of a typical upper carriage in the prefold/fold, fold, final fold and delivery modules.
Figures 12, 14, 15, 16:
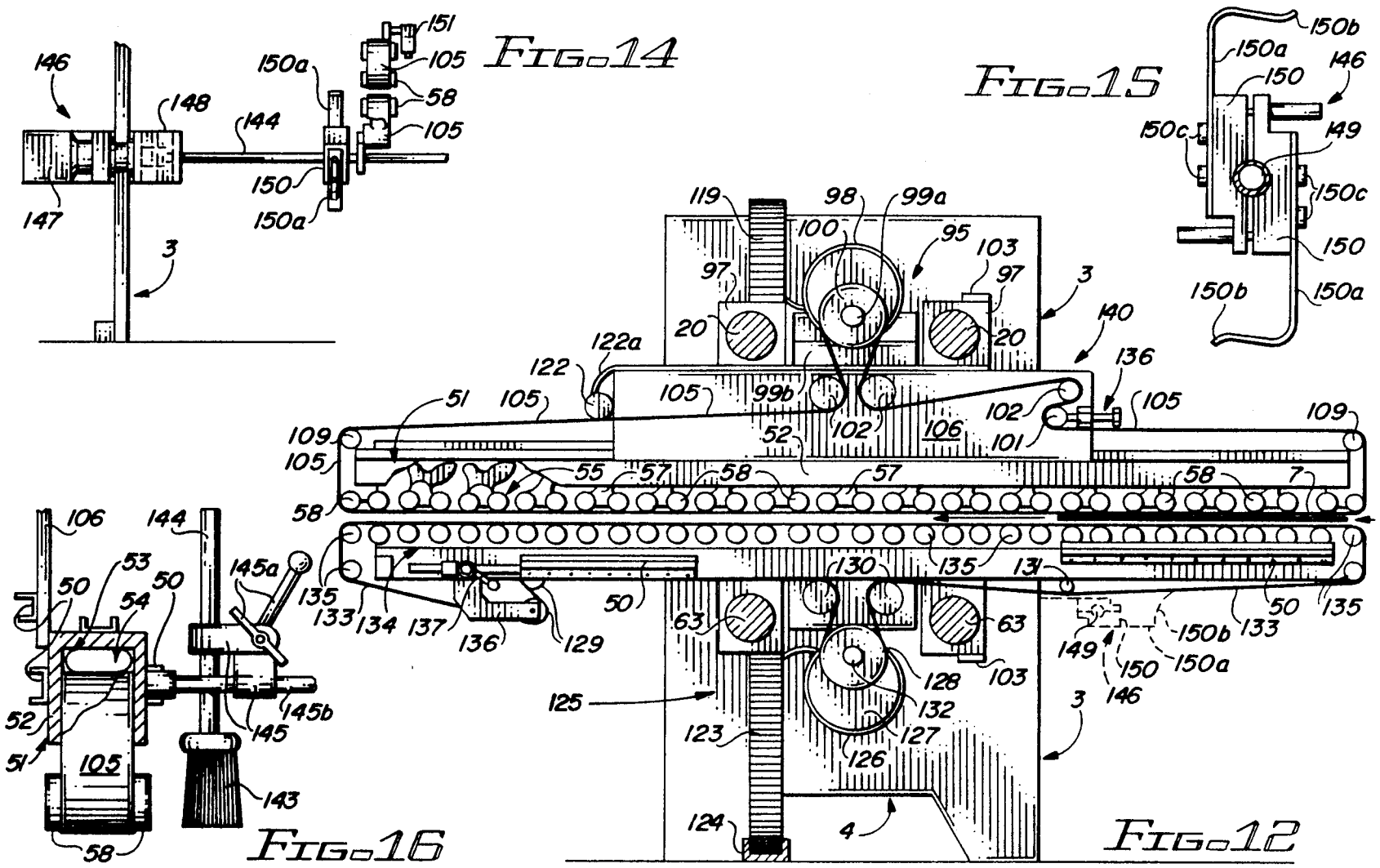
FIG. 12 is a side sectional view of a typical prefold-/fold, fold, final fold and delivery module.
FIG. 14 is a partial front view of a backfold apparatus.
FIG. 15 is an enlarged side view of the backfold arm hub and arm elements of the backfold apparatus illustrated in FIG. 14.
FIG. 16 is a front sectional view of a typical roller assembly frame, unistrut and brush configuration.
Figure 24:
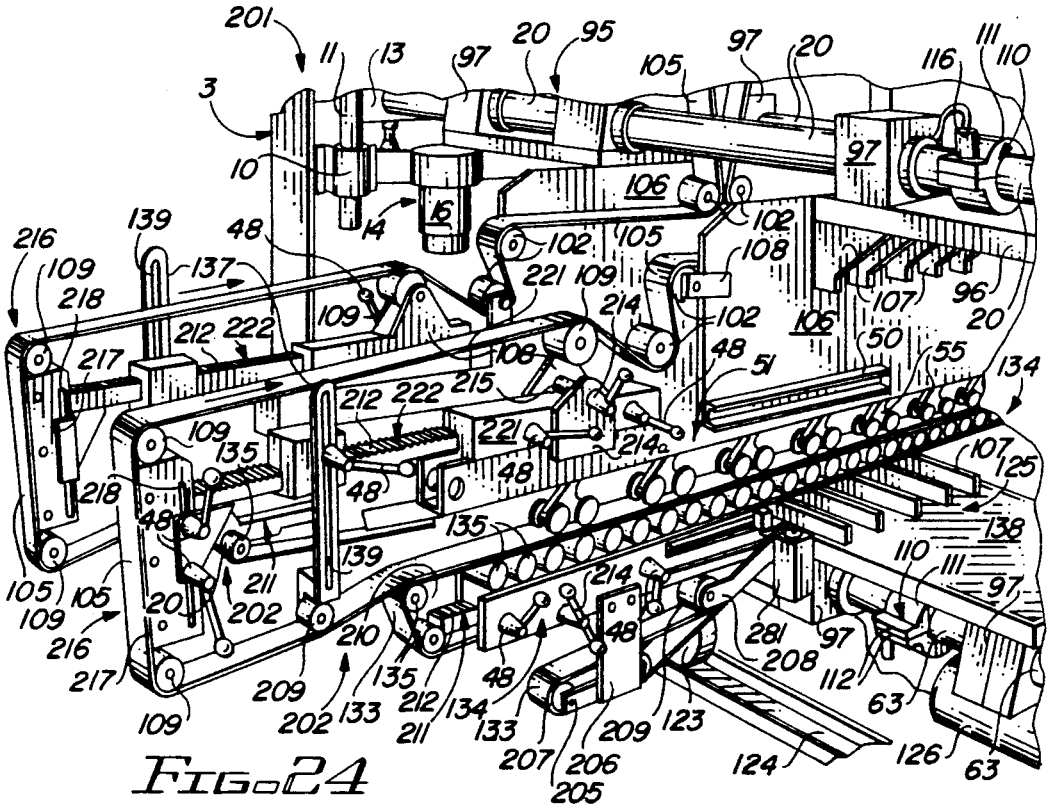
FIG. 24 is a perspective view of the delivery module of this invention.

Referring now to FIGS. 12, 13 and 24, each of the prefold/fold module 140, fold module 152, final fold module 156 and delivery module 201 includes a pair of oppositely-disposed upper carriages, generally illustrated by reference numeral 95. Each upper carriage 95 includes a horizontally-oriented carriage mount plate 96, attached to a vertically-oriented upper carriage panel 106 by means of panel gussets 107. Four carriage bearings 97 are secured to the four corners, respectively, of each carriage mount plate 96 and receive the upper horizontal guide rods 20 in spaced, slidable relationship, respectively. An upper carriage motor 98 is also provided in each of the upper carriages 95 and includes an upper carriage motor gearbox 99, which is mounted on a corresponding gearbox mount 99*b*, secured to the respective carriage mount plate 96, and secures each upper carriage motor 98 in spaced relationship with respect to the corresponding carriage mount plate 96. An upper carriage belt drive pulley 100 is secured to each of the gearbox shafts 99*a* of the upper carriage motor gearboxes 99 and receives a separate upper carriage belt 105, as further illustrated in FIG. 13. Upper idler rollers 102 are rotatably mounted on roller pins or brackets provided in each upper carriage panel 106 in spaced relationship, in order to maintain each upper carriage belt 105 around the corresponding upper carriage belt drive pulley 100 in driving, yet easily removable relationship. A pair of upper belt idler rollers 102 are also rotatably mounted on each upper carriage panel 106 and receive the respective upper carriage belts 105. An upper tensioning roller 101 also engages each of the upper carriage belts 105 and is mounted on a tension roller bolt 136, respectively, to tension the upper carriage belts 105, as illustrated in FIG. 12. Each upper carriage belt 105 extends around the corresponding upper carriage belt drive pulley 100, upper idler rollers 102, upper belt tensioning rollers 101 and multiple upper carriage belt rollers 58, which are rotatably attached to the respective upper carriage roller assemblies 51, mounted on the upper carriage panels 106, as further illustrated in FIGS. 12 and 24. The upper carriage belt rollers 58 are mounted in the respective upper carriage roller assemblies 51 as heretofore described with respect to the feed module 2, illustrated in FIG. 7.

Referring again to FIG. 13 of the drawings, the clam shell locks 110 are each characterized by a lock housing 111, shaped to define a pair of extending housing flanges 112, one of which receives a pneumatic cylinder 116. A cylinder air line 115 connects the pneumatic cylinder 116 to a clam shell manual valve 113, fitted with a valve lever 114, wherein manipulation of the valve lever 114 operates the clam shell manual valve 113 and loosens or tightens the housing flanges 112 and the block housing 111 to operate the clam shell lock 110 and selectively lock or facilitate slidably manipulation of each entire upper carriage 95 on the upper horizontal guide rods 20, as further hereinafter described. As further illustrated in FIG. 13, a pair of U-shaped upper wire ways 119 project outwardly from the side panels 3 in facing relationship in each of the feed modules 2, prefold/fold module 140, fold module 152, final fold module 156 and delivery module 201, to receiving wiring (not illustrated) connecting the respective upper carriage motors 98 to a control system and a source of electric current, as hereinafter further described. One end of each of the upper wire ways 119 is mounted on one of the carriage bearings 97 of each carriage mount plate 96, as further illustrated in FIG. 13, while the other end is attached to the corresponding side panel 3. Each of the upper wire ways 119 is further characterized by multiple wire way corregations 120, as illustrated in FIG. 13, to facilitate folding and unfolding of the upper wire ways 119 as the upper carriages 95 are slidably adjusted inwardly and outwardly on the parallel upper horizontal guide rods 20.

Referring to FIGS. 12 and 24 of the drawings, the lower carriages in the prefold/fold module 140 and the delivery module 201 are generally illustrated by reference numeral 125 and are also located in each of the other folder/gluer fold module 152 and final fold module 156. Each lower carriage 125 is positioned in each case beneath the respective corresponding upper carriage 95 and is mounted on a lower carriage frame 134, as illustrated. Each lower carriage 125 further includes a lower carriage mount plate 138, extending from the lower carriage frame 134, and a pair of lower carriage motors 126, fitted with lower carriage motor gearboxes 127, respectively, having projecting lower carriage gearbox shafts 132. Each lower carriage motor gearbox shaft 132 further receives a lower carriage belt drive pulley 128 in the same manner as the upper carriage belt drive pulleys 100 in the upper carriages 95, described above. A set of lower belt tensioning pulleys 129 receive a corresponding pair of lower carriage belts 133, which wind around the respective lower carriage belt drive pulleys 128 in parallel, driving relationship. Lower idler rollers 130, coupled with lower guide pulleys 131, also receive the lower carriage belts 133, respectively, and route the lower carriage belts 133 over parallel sets of lower carriage belt rollers 135, located in the lower carriage frames 134 immediately beneath corresponding parallel sets of upper carriage belt rollers 58, as further illustrated in FIG. 12. Referring again to FIG. 12, a pair of tension roller supports 136 are oriented with one end pivotally attached to a corresponding one of the lower carriage frames 134 and the opposite end fitted with a lower belt tension roller 129, in order to receive and tension each of the lower carriage belts 133, respectively. A lower wire may 123 is positioned beneath each of the lower carriages 125, with the top end of each lower wire way 123 attached to one of the carriage bearings 97 and the opposite end attached to a side panel 3 and engaging a lower wire way channel 124, resting on a supporting surface, as further illustrated in FIG. 24. When each lower carriage 125 is adjusted horizontally inwardly and outwardly on the corresponding lower horizontal guide rods 63, the lower wire way 123 folds in and out of the lower wire way channel 124 to support the lower wire way 123. Tape housings 103 are also mounted on the inside ones of the carriage bearings 97 for enclosing spring-loaded tapes 104 and measuring the desired adjustment of the upper carriages 95 and lower carriages 125 toward or away from each other on the upper horizontal guide rods 20 and lower horizontal guide rods 63, respectively, as illustrated in FIG. 13.

Referring again to FIGS. 2 and 16 of the drawings, the prefold/fold module 140 and fold module 152 are further characterized by a pair of brushes 143, mounted on brush shafts 144, each of which is fitted with a clamp 145, as detailed in FIG. 16. Each clamp is further characterized by a clamp handle **145*a* and a clamp shaft 145*b*, attached to a unistrut 50, mounted on the roller assembly frame 52 of the upper carriage roller assembly 51, for adjusting the brushes either laterally or vertically and/or pivotally, to further create a desired prefold/fold configuration in the respective panels of the cartons 7**.

A pair of backfold apparatus 146 are further detailed in FIGS. 2, 14 and 15 and are located in the prefold/fold module 140 and the fold module 152 for creating a backfold in the trailing panels of the respective cartons 7. Each backfold apparatus 146 is further characterized by a backfold motor 147, as illustrated in FIG. 14, which backfold motor 147 is fitted with a backfold gearbox 148 and a backfold shaft 149 runs through the backfold motor 147 and the backfold gearbox 148, into the proximity of the upper carriage belt rollers 58 and lower carriage belt rollers 135. As illustrated in FIG. 15 an arm hub 150, secured to the extending end of the backfold shaft 149, is fitted with an outwardly-extending arms **150*a* having curved arm fingers 150*b* defined in the ends thereof. Hub bolts 150*c* serve to anchor the arm hub 150 and arms 150*a* securely, yet adjustably, on the backfold shaft 149. The backfold shaft 149 is located such that the backfold arms 150*a* and the backfold arm fingers 150*b* are positioned beside the lower carriage belt rollers 135, to facilitate backfolding of the respective trailing panels of the cartons 7 as the cartons 7 traverse the upper carriage belt rollers 58 and the lower belt rollers 135 in spaced sequence during operation of the carton folding apparatus 1, as hereinafter further described. Referring again to FIG. 12, a sensing roller 122 is mounted on one end of a sensing roller mount 122*a*, attached to an upper carriage panel 106, for engaging an upper carriage belt 105 and electronically sensing the speed of the upper carriage belt 105 and controlling the folding timing in operation of the backfold apparatus 146** and the glue application apparatus, as hereinafter further described.

A fold module 152 is positioned end-to-end alignment with the prefold/fold module 140, as illustrated in FIGS. 1 and 2. Like the prefold/fold module 140, the fold module 152 is fitted with two sets of upper carriage belt rollers 58 and lower belt carriage rollers 135 in vertical alignment and either aligned with, or located in a parallel plane to, but not connected to, the corresponding sets of upper carriage belt rollers 58 and lower belt carriage rollers 135 in the prefold/fold module 140. Accordingly, it will be appreciated that when the cartons 7 reach the discharge end of the prefold/fold module 140, they immediately enter the loading end of the fold module 152 and are caused to travel therein in the same direction and at the same speed by operation of the respective sets of upper carriage belts 105 and lower carriage belts 133 in the prefold/fold module 140. A pair of folding blocks 153 are provided in the prefold/fold module 140 and the fold module 152 as illustrated in FIG. 2 and are mounted in similar manner, except on opposite sides of the lower carriage belt frame 134. A front fold arm 154 is also located in the prefold/fold module 140 and is mounted on a front fold arm shaft 155 which extends from a unistrut (not illustrated) into the path of the cartons 7 that are traversing the respective upper carriage belts 105 and lower carriage belts 133 in the prefold/fold module 140. As the curved end of the front fold arm 154 engages the front, or leading edge panel (not illustrated) of each respective carton 7 in sequence, that panel is caused to crease upwardly and fold accordingly. Furthermore, the folding blocks 153 and brushes 143 then engage the side panels of each of the cartons 7 in sequence and effect folding of the side panels.

Figure 20:
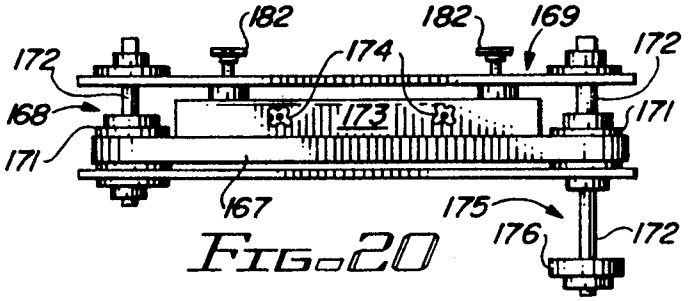
FIG. 20 is a side view of the sizing belt subunit illustrated in FIGS. 18 and 19.
Figure 17:
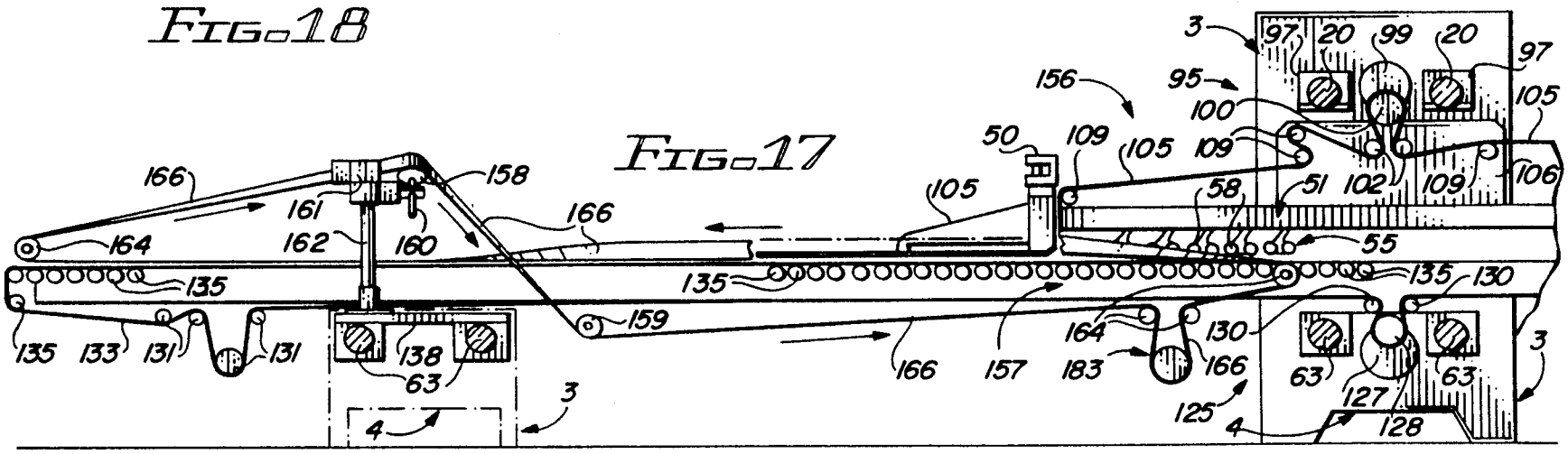
FIG. 17 is a side sectional view of the final fold module with the sizing belt subunits removed for brevity.
Figure 19:
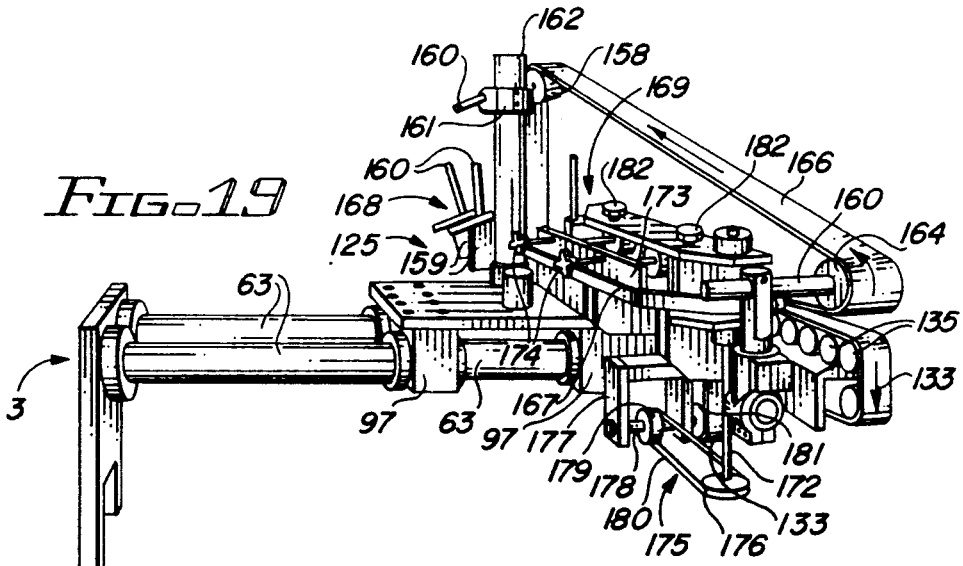
FIG. 19 is a perspective view of the sizing belt subunit illustrated in FIG. 18.

Referring again to FIGS. 1, 2, 4 and 17–20 of the drawings, the final fold module 156 is illustrated in alignment with the fold module 152, such that the respective upper carriage belts 105 and lower carriage belts 133 of the respective fold module 152 and final fold module 156 may be longitudinally aligned or misaligned in parallel planes, but not connected. Accordingly, transition of the cartons 7 from the discharge end of the fold module 152 to the loading end of the final fold module 156 is smooth and at a common speed, such that the spacing between the respective cartons 7 is not changed. Referring now to FIGS. 12, 13 and 17 of the drawings, the final fold module 156 is characterized by parallel, elongated final fold bottom roller frames 157, which receive the two sets of lower carriage belt rollers 135 and lower carriage belts 133 in a longer parallel, belt-traversing relationship than the lower carriage frame 134 in the prefold/fold module 140 and fold module 152. However, as heretofore described, the respective upper carriages 95 and lower carriages 125 are designed in the same manner as their counterparts in the prefold/fold module 140 and fold module 152 in handling the respective upper carriage belts 105 and lower carriage belts 133. The upper carriages 95 are secured to the respective upper carriage roller assemblies 51 and the lower carriages 125 are mounted on the final fold bottom roller frame 157, and both carriages are also horizontally adjustable on the respective upper horizontal guide rods 20 and lower horizontal guide rods 63, respectively. Moreover, the upper carriages 95 may be raised and lowered on the respective vertical guide rods 11, illustrated in FIG. 4. A series of conical guide rollers 158 and cylindrical guide rollers 159 are attached by means of guide roller shafts 160 to various areas of the bottom roller frame 157 and to shaft clamps 161, attached to the respective shaft clamp supports 162, having adjusting handles 163. As further illustrated in FIGS. 17 and 21, the conical guide rollers 158 and cylindrical guide rollers 159 are designed to accommodate a pair of fold belts 166 which are also looped around corresponding fold belt guide rollers 162, located at opposite ends of the final fold module 156 in spaced relationship. In addition to accommodating the respective fold belts 166, the final fold module 156 also mounts a pair of oppositely-disposed sizing belt units 168, each of which includes a sizing belt frame 169, four sizing belt rollers 170 and a sizing belt 167, located on each of the fours sizing belt rollers 170, respectively, and positioned to engage opposite, parallel edges of the cartons 7. The sizing belts 167 also traverse a pair of sizing belt pulleys 171, disposed at each of the sizing belt frame 169, which sizing belt pulleys 171 are each mounted on a pulley shaft 172, seated in bearings (not illustrated) located in the sizing belt frame 169. A pair of belt positioning plates 173 are located in parallel, spaced relationship in the sizing belt frames 169, respectively, and a pair of belt positioning screws 174 are threadably extended through the belt positioning plates 173 for selectively placing the sizing belts 167 by adjusting the spacing between the respective belt positioning plates 173. A sizing belt transfer 175 is detailed at one end of each of the sizing belt frames 169 as illustrated in FIGS. 19 and 20 and includes a sizing belt transfer pulley 176, located on the bottom end of each of the pulley shafts 172 and a bracket shaft pulley 179, mounted on a bracket shaft 178, mounted on a corresponding sizing belt transfer bracket 177, attached to each of the sizing belt frames 169, respectively, with a transfer belt 180 connecting each of the bracket shaft pulleys 179 and the corresponding sizing belt transfer pulleys 176, respectively. The lower carriage belts 133 each traverse a corresponding lower carriage belt transfer pulley 181, located on the bracket shaft 178 with the bracket shaft pulley 179, such that rotation of the bracket shaft 178 by operation of each lower carriage belt 133 drives the corresponding bracket shaft pulley 179 and sizing belt transfer pulley 176, which are equal in size, to operate the sizing belt 167 at the same speed of the lower carriage belts 133. Accordingly, each of the sizing belts 167 serves to help realign and prevent skewing of the respective cartons 7 as they sequentially traverse the respective upper carriage belts 105 and lower carriage belts 133 in the final fold module 156.

Figure 22:
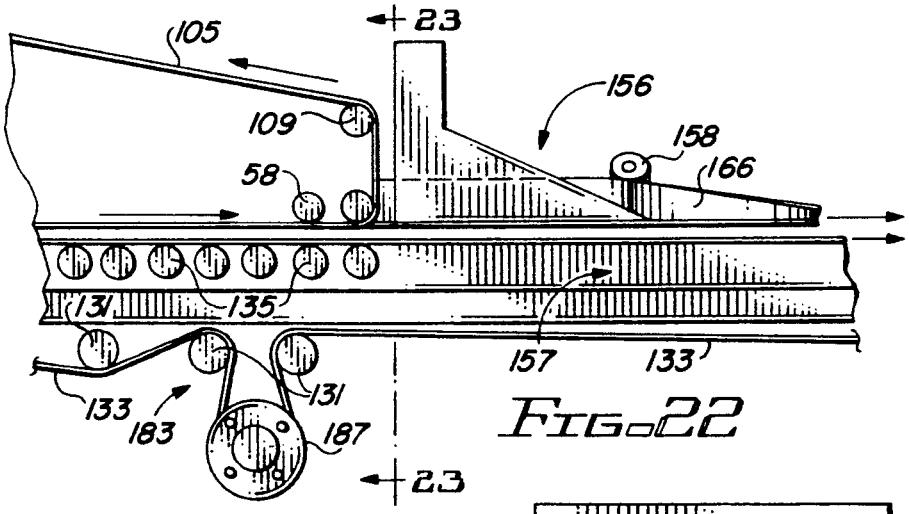
FIG. 22 is a side view, partially in section, of a fold belt transfer element of the final fold module.
Figure 23:
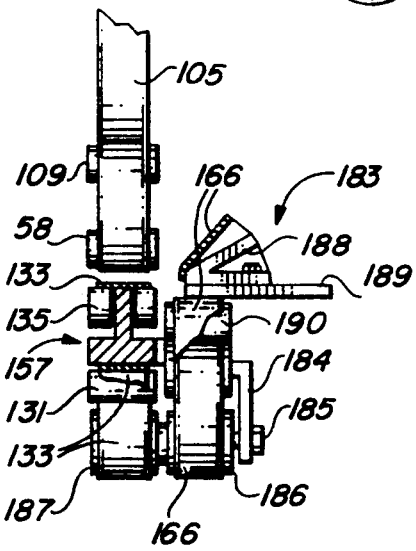
FIG. 23 is a sectional view taken along line 23—23 of the fold belt transfer element illustrated in FIG. 22.

Referring now to FIGS. 17, 22 and 23 of the drawings, a fold belt transfer 183 is also provided in both roller units of the final fold module 156 in spaced relationship with respect to the sizing belt transfers 175. The function of the fold belt transfers 183 is to drive the fold belts 166 at the same speed as the lower carriage belts 133. A transfer bracket 184 is mounted on each of the final fold bottom roller frames 157 of the final fold module 156 and supports a bracket bolt 185, which acts as a pin upon which the fold belt transfer roller 186 and lower carriage belt transfer roller 187 are journalled for rotation in side-by-side relationship, respectively, as illustrated in FIG. 23. The fold belts 166 are caused to traverse the respective folding templates 188, secured to the template bases 89 and the fold belt transfer rollers 186, while the lower carrier belts 133 are looped around the corresponding lower carriage belt transfer rollers 187. Accordingly, as further illustrated in FIGS. 22 and 23, operation of the lower carriage belts 133 at a selected folder/gluer belt speed also causes the fold belts 166 to operate at the same speed, thereby assuring that each belt which contracts the respective cartons 7 is operating at the same linear speed.

Referring now to FIGS. 1, 2 and 24 of the drawings, the delivery module 201 is illustrated and although incorporating substantially identical upper carriages 95 and lower carriages 125 to the upper carriages 95 and lower carriages 125 of the prefold/fold module 140, fold module 152 and final fold module 156, the delivery module 201 also includes parallel, adjustable upper section noses 216 and lower section noses 202 to facilitate accurate delivery of the cartons 7 to the stacker 225. Accordingly, adjustment of the upper carriages 95 and lower carriages 125 to horizontally adjust the accompanying upper carriage roll assemblies 51 and lower carriage frames 134 inwardly and outwardly on the upper horizontal guide rods 20 and lower horizontal guide rods 63, respectively, to accommodate cartons 7 of selected width, is achieved in the same manner as in the prefold/fold module 140, fold modules 152 and final fold module 156. Vertical adjustment of each of the upper carriages 95 is also effected by slidable adjustment of the respective parallel upper horizontal guide rods 20 on the vertical guide rods 11, provided in each of the facing guide rod assemblies 9 which are attached to the oppositely-disposed side panels 3, as illustrated in FIG. 4. Each of the low section noses 202 includes a pair of belt rollers 135, mounted on a lower rack plate 210, to which is secured a lower rack 211. Each lower rack 211 further includes rack teeth 212 and a pair of clamp levers 48, mounted on each lower carriage frame 134, positioned adjacent to the lower racks 211, respectively, for clamping the lower racks 211 in a selected extended configuration with respect to the lower carriage frames 134. A spur gear lever 214 is also mounted on each lower carriage frame 134 and incorporates a spur gear (not illustrated) which engages the rack teeth 212 in the lower racks 211 to facilitate extension and retraction of the low section noses 202 inwardly and outwardly, independently or in concert, in horizontal configuration, responsive to rotation of the spur gear levers 214. A pair of upper section noses 216 are also provided in spaced relationship in the delivery module 201 above the low section noses 202 and each include a pair of upper guide rollers 109, rotatably mounted on each end of a vertically-oriented upper section nose plate 217, which is provided with a vertical plate slot 218 and clamp levers 48. Each of the upper section nose plates 217 is mounted on the end of an upper rack 222, provided with rack teeth 212 and fitted with an upper rack housing 221, which receives a tensioning roller support 137, having a vertical clamp slot 139, which receives a clamp lever 48, and a corresponding tensioning roller 209. The tensioning rollers 209 each engage an upper carriage belt 105, to provide a selected degree of tension in, and raise and lower, the upper carriage belts 105 by operation of the clamp lever 48. Additional clamp levers 48 are provided in the upper rack housings 221, respectively, for tightening the upper racks 222 in the upper rack housings 221. A spur gear lever 214 is also provided on each of the upper rack housings 221 for manipulating a spur gear 215, which engages a second spur gear (not illustrated) located inside each of the upper rack housings 221 and engaging the rack teeth 212 of the lower racks 211 to facilitate movement of the upper racks 222 inwardly and outwardly of the upper rack housings 221, respectively, and extending and retracting the upper section noses 216, as desired. Accordingly, it will be appreciated from a consideration of the delivery module 201 illustrated in FIG. 24, that both sets of upper section noses 216 and lower section noses 202 can be adjusted inwardly and outwardly with respect to the upper carriages 95 and lower carriages 125 to position the upper carriages belts 105 and lower carriage belts 133 in a selected position with respect to the stacker 225 and each other, as hereinafter further described. Consequently, cartons 7 which are moved through the final fold module 156 are discharged from the final fold module 156 into the receiving end of the delivery module 201 between the respective upper carriage belts 105 and lower carriage belts 133 and are discharged to the stacker 225 between the low section noses 202 and upper section noses 216, respectively. Since the operational speed of the upper carriage belts 105 and lower carriage belts 133 in the delivery module 201 is the same as that in the prefold/fold module 140, fold module 152 and final fold module 156 due to synchronous operation of the respective upper carriage motors 98 and lower carriage motors 126, the cartons 7 move through the delivery module 201 at the same speed at which they traversed the prefold/fold module 140, fold module 152 and final fold module 156. As further illustrated in FIG. 24, the lower carriage belts 133 also each traverse a pair of hanger rollers 207, mounted on a hanger roller mount 206, mounted on a hanger plate 205, which extends from the lower carriage frame 134.

Figure 27:
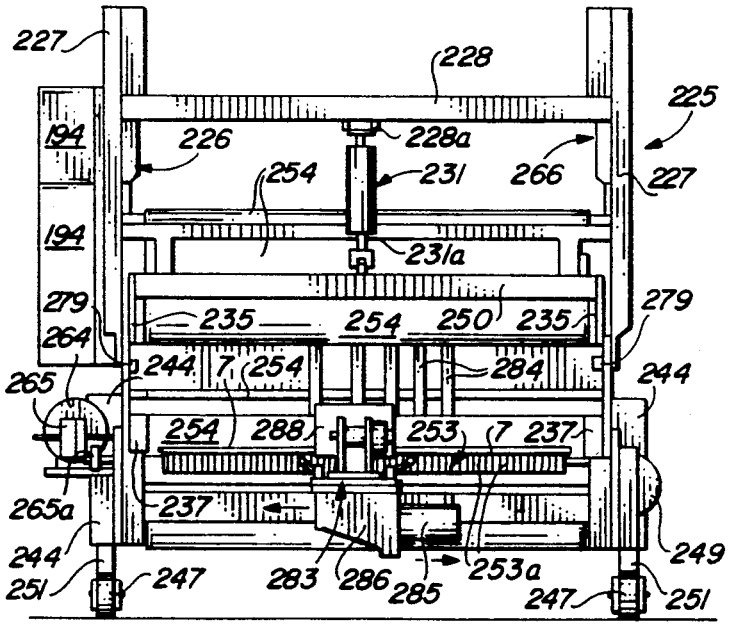
FIG. 27 is a front end view of the stacker unit illustrated in FIGS. 25 and 26.
Figures 25, 26:
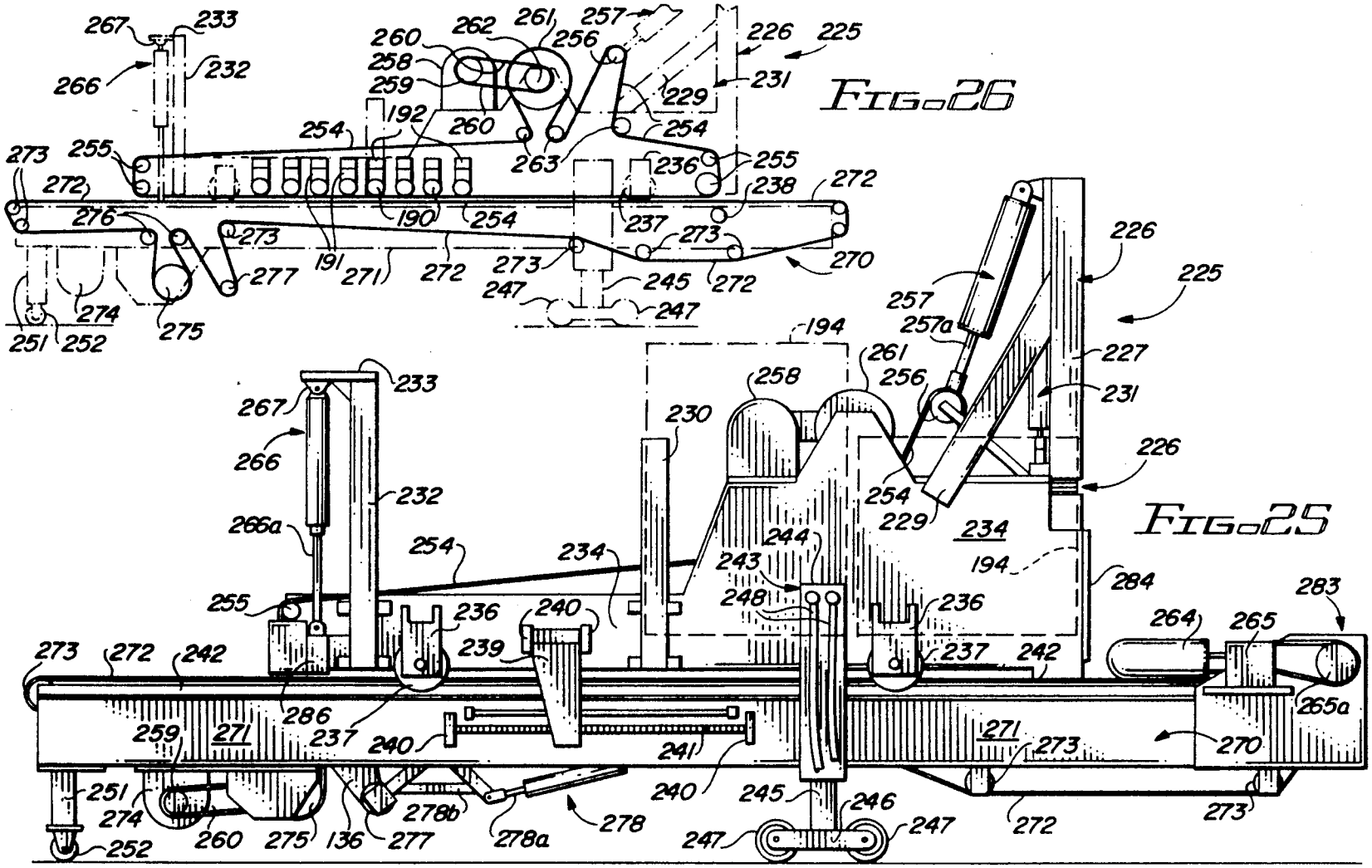
FIG. 25 is a side view of the stacker unit of this invention.
FIG. 26 is a side view of the stacker unit with the structural components illustrated in phantom to highlight the upper and lower belt configurations.

Referring now to FIGS. 1, 2 and 25–28, the cartons 7 are transferred from the delivery module 201 to the stacker 225, positioned immediately adjacent to the delivery module 201 and provided with an upper stacker frame 226 and a cooperating lower stacker frame 270. The cartons 7 are stacked on the forward portion of the lower stacker frame 270 and when the level of cartons 7 reaches a certain height, a pair of stacker photocells 279 sense the presence of the cartons 7 and causes the upper stacker belt 254 and lower stacker belt 272 to move responsive to energizing of the upper stacker belt drive motor 258 and lower stacker belt drive motor 274, respectively. The lower stacker belt 272 is mounted on lower stacker belt rollers 273 and moves in a continuous loop around the lower stacker frame 270, as illustrated in FIG. 26. The lower stacker belt 272 also traverses a lower stacker drum 275 and is maintained in driving relationship on the lower stacker drum 275 by operation of the lower stacker idler rollers 276, which are positioned adjacent to the lower stacker drum 275. A lower stacker belt tensioning cylinder 278 is attached to the lower stacker frame 270 and the cylinder piston 278*a* engages a cylinder frame 278*b*, which engages the lower stacker belt tensioning roller 277 that engages the lower stacker belt 272, for applying a desired degree of tension in the lower stacker belt 272. The frame lift cylinder housing 244 of a hydraulic frame lift 243 is vertically oriented on the lower stacker frame 270 and encloses a hydraulic cylinder (not illustrated) which receives a frame lift piston 245, to the extending end of which is attached a piston trolley 246, carrying trolley rollers 247. A hydraulic pump 249 is also mounted on the lower stacker frame 270 and hydraulic fittings (not illustrated) connect hydraulic hoses 248 to the hydraulic cylinder located in the frame lift cylinder housing 244 and the hydraulic pump 249, respectively, to facilitate extension and retraction of the frame lift piston 245 with respect to the frame lift cylinder housing 244 and to raise and lower the lower stacker frame 270. A rear frame support 251 is provided at the rear end of the lower stacker frame 270 and carries a rear frame support roller 252, to further stabilize the lower stacker frame 270 securely on a supporting surface. A ball screw 241 is secured in horizontal relationship on each side of the lower stacker frame 270 between a pair of ball screw mounts 240, attached to the lower stacker frame 270, and a ball screw arm 239 is oriented with one end secured to a pair of ball screw arm mounts 240, which are welded or otherwise secured to the side panels 234 of the upper stacker frame 226, as illustrated in FIG. 25. The opposite ends of the ball screw arms 239 are each fitted with a threaded ball nut (not illustrated) engaging the ball screw 241, for purposes which will be hereinafter further described. A pair of frame rails 242 are also provided in spaced, longitudinal relationship on the lower stacker frame 270 for purposes which will also be hereinafter further described. A spanker is generally illustrated by reference numeral 283 and is mounted on the front end of the lower stacker frame 270, positioned beneath the upper section noses 216 of the delivery module 201. Accordingly, it will be appreciated that when the cartons 7 are delivered from the delivery module 201, they drop over the spanker 283 and onto that portion of the lower stacker frame 270 which extends between the spanker 283 and the speaker anvils 284, mounted on the upper stacker frame 226, as illustrated in FIGS. 25 and 27. The spanker 283 is further characterized by a spanker motor 285 and a spanker gearbox 286 to operate the reciprocating spanker plate 288, illustrated in FIG. 27. Accordingly, it will be appreciated by those skilled in the art that the spanker 283 operates to repetitively engage the trailing edges of the cartons 7 when the cartons 7 are stacked on the lower stacker frame 270 between the spanker anvils 284 and the spanker plate 288, to maintain alignment and proper positioning of the cartons 7 on the lower stacker frame 270, and facilitate feeding of the cartons 7 in lapped relationship through the stacker 225, between the upper stacker belt 254 and the lower stacker belt 272.

Figure 28:
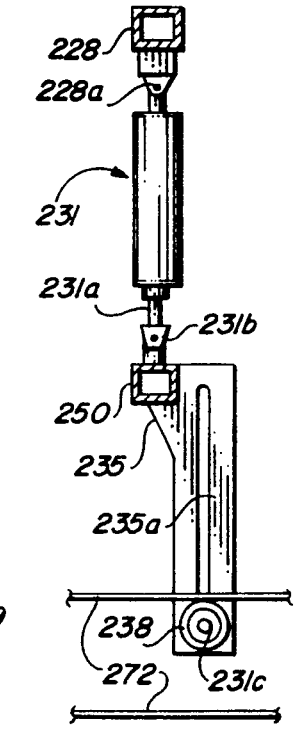
FIG. 28 is a side sectional nip roller assembly detail.

Referring again to FIGS. 25–28, the upper stacker frame 226 of the stacker 225 is further characterized by a pair of spaced cylinder mount posts 227 which span the upper stacker frame 226 and are connected by a cylinder mount strut 228, from which is suspended a brace clevis 228*a*, securing the cylinder end of a nip roller tensioning cylinder 231. The piston 231*a* of the nip roller tensioning cylinder 231 is secured to a nip roller frame 235 by means of a piston clevis 231*b*, attached to a nip roller frame bar 250, which is welded to the nip roller frame 235. The nip roller frame 235 further includes a vertical frame slot 235*a*, which carries a nip roller 238, as illustrated in FIG. 28. The nip roller 238 is secured in the vertical frame slot 235*a* by means of a pin 231*c*, and the nip roller 238 is located beneath the top loop of the lower stacker belt 272, as further illustrated in FIG. 28. Accordingly, operation of the nip roller tensioning cylinder 231 to extend and retract the nip roller tensioning cylinder piston 231*a* raises and lowers the nip roller frame bar 250 and the nip roller frame 235 and exerts pressure on the top loop of the lower stacker belt 272. A belt tensioning cylinder 257 is also suspended from the cylinder mount posts 227 of the upper stacker frame 226, the cylinder piston 257*a* of which receives an upper stacker belt tensioning roller 256, which also engages the upper stacker belt 254 to adjust the tension in the upper stacker belt 254. The upper stacker belt 254 is driven by an upper stacker belt drive motor 258, having a motor pulley 259 attached in driving relationship to the drum pulley 262 of an upper stacker drum 261, by mean of a pulley belt 260. Since the upper stacker belt 254 also extends around the upper stacker drum 261 in looped, driving relationship by operation of the upper stacker idler rollers 263, operation of the belt tensioning cylinder 257 applies a selected degree of tension in the upper stacker belt 254. A pair of rear cylinders 266 are mounted on a rear cylinder mount post 232, extending upwardly from the rear area of the upper stacker frame 226 and a post cap 233 is mounted on the top end of the rear cylinder mount post 232 for securing the rear cylinders 266 by means of a pair of cylinder clevis 267. The rear cylinder pistons 266*a* extend downwardly and are attached to frame blocks 268, which are rigidly secured to the side panels 234. This design feature serves to exert an upward force on the rear end of the upper stacker frame 226 and helps the upper stacker belt 254 accommodate the lapped cartons 7 as the cartons 7 move through the stacker 225, and minimizes crushing of the cartons 7. Accordingly, it will be appreciated by a consideration of FIGS. 25–27 that as the folded and glued cartons 7 are delivered from the delivery module 201 to the lower stacker frame 270 of the stacker 225, bottom feeding of the cartons 7 from the stack of cartons 7 is effected when the stacker photocells 279 sense the top cartons 7 in the stack. The cartons 7 are bottom-fed through the stacker 225 between the upper stacker belt 254 and the lower stacker belt 272 in lapped configuration, as long as the photocells 279 detect the stacked cartons 7, and the cartons 7 continue to the rear end of the lower stacker frame 270, where they are removed and packed.

Figure 29:
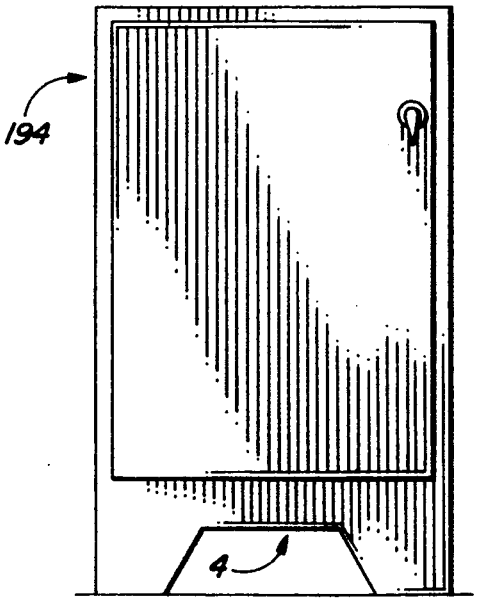
FIG. 29 is a front view of a typical electrical control cabinet.

Referring again to the drawings, the carton folding apparatus 1 is operated as follows. A stack of unfolded cartons 7 having a desired panel configuration is located on the feed belts 68, in the lower feed assembly 65, as illustrated in FIG. 1. The carton guides 24 are then adjusted laterally on the upper horizontal guide rods 20 by loosening the corresponding adjusting knobs 35 to engage opposite edges of the cartons 7 and are then tightened to stabilize the cartons 7 on the respective feed belts 68. The feed gates 30 are then similarly adjusted by grasping the gate grips 34, loosening the corresponding adjusting knobs 35 in the gate bearings 32, spacing the feed gates 30 against the leading edges of the cartons 7 and retightening the adjusting knobs 35. The carton supports 44 are then similarly adjusted laterally along the cow-catcher cross-member 38 of the cow catcher 37, such that the support rod rollers 47 engage the trailing edges of the cartons 7 to tilt the entire stack of cartons 7 upwardly and point the respective leading edges of the cartons 7 downwardly against the feed gates 30. Appropriate controls located in the electrical control cabinets 194, positioned adjacent to the feed module 2, prefold/fold module 140, fold module 152, final fold module 156, delivery module 201 and stacker 225 as illustrated in FIGS. 2 and 29 of the drawing, are then activated to initiate synchronized driving of the respective feed belts 68, lower carriage belts 133, upper carriage belts 105, fold belts 166 and sizing belts 167, by operation of the respective feed belt drive motor 78, upper carriage motors 98 and lower carriage motors 126, respectively. In a preferred embodiment, these motors operate in a "master-slave" relationship as illustrated in FIG. 30 and one of the drive motors, preferably either an upper carriage motor 98 or a lower carriage motor 126, acts as the "master" sensing motor for determining the synchronous operation speed of the remaining motors, according to the knowledge of those skilled in the art. Once synchronous operation of the respective drive motors is accomplished, the cartons 7 are fed through the feed module 2 between the upper carriage belt rollers 58 and the feed belts 68. This bottom feeding operation is aided by the vacuum pulled on the respective vacuum plates 71 through the vacuum manifold 90 and vacuum pump (not illustrated). The vacuum is applied to the bottom surfaces of the respective cartons 7, through the belt perforations 68*a* located in the feed belts 68, as illustrated in FIG. 3. Accordingly, the cartons 7 are sequentially fed through the feed module 2 of the carton folding apparatus 1 in spaced relationship to exit the feed module 2 onto the prefold/fold module 140, the respectively parallel sets of upper carriage belts 105 and lower carriage belts 133 of which are aligned in parallel planes with the respective upper carriage belt rollers 58 and feed belts 68, located in the feed module 2. As the cartons 7 traverse the prefold/fold module 140 in spaced, aligned relationship by operation of the upper carriage belts 105 and corresponding lower carriage belts 133, the trailing edges of the cartons 7 are sensed by a backfold photoeye 151, located in the prefold/fold module 140 upstream from backfold apparatus 146. As the trailing edge panel of each carton 7 approaches the arms 150*a* and arm fingers 150*b* of the backfold apparatus 146, the arms 150*a* are caused to rotate by operation of the backfold motor 147 and backfold gearbox 148, such that the arm fingers 150*b* engage the trailing panel of each carton 7 to fold the trailing panel upwardly. The backfold motor 147 is then caused to continue rotation of the arm hub 150 and the arms 150*a* to remove the arms 150*a* and the arm fingers 150*b* from the path of the next successive carton 7, to repeat the operation. The backfold gearbox 148 operates to reduce the inertia of the arm hub 150 and arms 150*a* during rotation to prevent excessive "slapping" of the trailing panel by the arm fingers 150*b* in the backfolding process. Each backfold motor 147 may be programmed by a programmable motor controller to operate in a selected engaging and disengaging sequence, according to the knowledge of those skilled in the art and also operates according to the uniform speed of the respective upper carriage belts 105 and lower carriage belts 103, as this speed is electronically gauged by the sensing roller 122, illustrated in FIG. 12. As the cartons 7 continue to progress through the prefold/fold module 140, the panels engage the folding blocks 153, which crease certain panels in a folded configuration for final folding at a later point in the carton folding apparatus 1. Other panels, such as the leading panel in each respective cartons 7, may be energized by the front fold arm 154, provided in the prefold/fold module 140, as illustrated in FIG. 2, to prefold or fold this panel upwardly, as heretofore described.

As the cartons 7 continue through the prefold/fold module 140, they are discharged on to a corresponding fold module 152, which is aligned with the prefold module 140 as illustrated in FIGS. 1 and 2. While the respective upper carriages 95 and lower carriages 125 in the fold module 152 are opened farther apart on the upper horizontal guide rods 20 and the lower horizontal guide rods 63 for purpose of illustration, it will be understood that under normal operating circumstances the upper carriages 95 and lower carriages 125 are adjusted to align or misalign in parallel planes, to correctly transfer the cartons 7 through the fold module 152. Accordingly, the spacing of the respective lower carriages 125 in FIG. 2 is indicated for purposes of illustration only. As the respective cartons 7 move through the fold module 152 between the parallel sets of upper carriage belts 105 and lower carriage belts 133, the trailing edges or panels traverse a second backfold photoeye 151, which operates to energize the corresponding backfold apparatus 146 and engage and fold the inside panels of the cartons 7, under circumstances where the first backfold photoeye 151 located in the prefold/fold module 140 has effected a backfold in the outer panels of the cartons 7. However, if only an outside panel backfold is necessary or desirable, for example, the first backfold photoeye 151 is rendered electronically inoperable and the second backfold photoeye 151 located in the fold module 152 operates to effect this fold by operation of the arm hub 150 element of the second backfold apparatus 146, as further illustrated in FIG. 2 and as described above. Furthermore, side and/or front panels of the cartons 7 engage the various folding blocks 153 and/or brushes 143, also illustrated in FIG. 2, to effect additional folding of the panels according to a preselected folding sequence in the prefold/fold module 140 and fold module 152.

Figure 21:
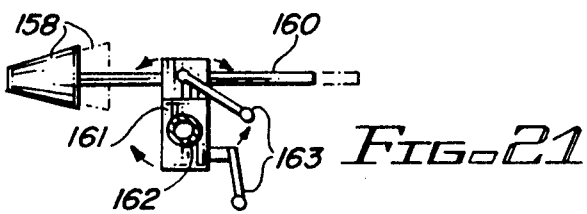
FIG. 21 is a front view of a typical folding belt guide roller element of the final fold module.
Figure 18:
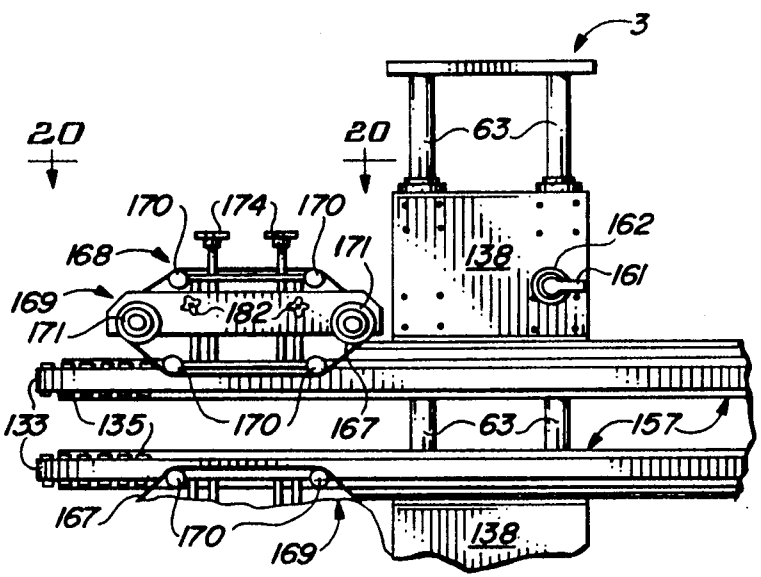
FIG. 18 is a top view, partially in section, of a sizing belt subunit of the final fold module.

Referring now to FIGS. 17–21, the cartons 7 are discharged from the fold module 152 onto the final fold module 156, which is provided with upper carriage belt rollers 58, carrying upper carriage belts 105 and lower carriage belt rollers 135, carrying parallel lower carriage belts 133, which may be aligned or misaligned with corresponding elements located in the fold module 152, depending upon the desired folding configuration, as described above. Accordingly, the cartons 7 are smoothly transferred at a common speed from the fold module 152 to the final fold module 156, which is further equipped with fold belts 166, that engage the side panels of the cartons 7, causing the side panels to fold in sequence over each other as the cartons 7 move through the final fold module 156. It will be appreciated that the fold belt 166 is mounted on adjustable conical guide rollers 158 and cylindrical guide rollers 159, as illustrated in FIGS. 17, 19 and 21, to effect the desired sequence of folding of a right-hand panel over a left or a left-hand panel over a right, as desired, according to the knowledge of those skilled in the art. The carton gluing operation also takes place in the final fold module 156 by means of multiple glue applicators, represented by the glue applicator 196, provided with a glue nozzle 197, illustrated in the final fold module 156 detailed in FIG. 1, and further according to the knowledge of those skilled in the art. Application of glue from the glue nozzle 197 is electronically synchronized with the proper gluing position of the respective cartons 7 by operation of the sensing roller 122, illustrated in the prefold/fold module 140, detailed in FIG. 15. A pair of oppositely-disposed sizing belt units 168 are further illustrated in FIGS. 2 and 18–20 and include corresponding sizing belts 167 for correcting random skewing of the cartons 7 which may occur during the journey through the carton folding apparatus 1. The folded and glued cartons 7 are ejected from the discharge end of the final fold module 156 onto the receiving end of the delivery module 201, which is aligned with the final fold module 156 and is further illustrated in FIGS. 1 and 2. Like the feed module 2, prefold/fold module 140 and fold module 152, the respective upper carriage belts 105 and lower carriage belts 133 in the delivery module 201 are selectively aligned or misaligned with their counterparts in the final fold module 156, depending upon the desired folding configuration of the cartons 7, to facilitate a smooth, unidirectional, constant speed transfer of folded and glued cartons 7 from the final fold module 156 to the delivery module 201. The folded and glued cartons 7 continue their travel between the respective parallel sets of upper carriage belts 105 and lower carriage belts 133 in the delivery module 201 until they are discharged from the lower section noses 202, which carry the lower carriage belts 133, respectively, and the upper section noses 216, which carry the upper carriage belts 105, respectively. As heretofore described, and referring agin to FIGS. 1 and 24, the lower section noses 202 and upper section noses 216 can be extended or retracted by operation of the respective lower racks 211 and upper racks 222 to locate the lower section noses 202 and the upper section noses 216 in a desired proximity with respect to the stacker 225, as particularly illustrated in FIG. 1.

Referring now to FIGS. 25–28, as the cartons 7 accumulate in a stack on the front portion of the stacker frame 270, they are aligned longitudinally by operation of the spanker 283, which is operated by a spanker motor 285. In operation, the spanker 283 causes the spanker plate 288 to periodically and repetitively contact the trailing edges of the cartons 7 in stacked relationship to align the leading and trailing edges of the cartons 7, preparatory to bottom feeding of the cartons 7 through the stacker 225 between the upper stacker belt 254 and the lower stacker belt 272. When the stack of folded and glued cartons 7 is sufficiently high to interrupt the beam between the two stacker photocells 279, illustrated in FIG. 27, the lower stacker drive motor 274 and upper stacker drive motor 258 operate to drive both the upper stacker belt 254 and lower stacker belt 272. The leading edges of the folded cartons 7 are urged into the "nip" between the nip roller 238 and the upper stacker belt rollers 255 by a stacker feed roller 253, which is fitted with spaced O-rings **253*a*, for better adhesion with the cartons 7. A steady stream of folded and glued cartons 7 is then moved through the stacker 225 in lapped relationship where the nip roller tension cylinder 231, illustrated in FIGS. 25–28, operates to create a "nip" of desired spacing between the lower stacker belt 272 and the upper stacker belt 254. This nip is created by raising and lowering the nip roller frame 235 and the nip roller 238 to in turn, raise or lower the upper loop of the lower stacker belt 272, as illustrated in FIG. 28. The lapped cartons 7 continue to move through the stacker 225 between the upper stacker belt 254 and lower stacker belt 272 against the downward bias of the lower segment of the lower stacker belt 272, which bias is created by multiple top yielding compression rollers 190, extending across the lower stacker belt 272, and attached to corresponding compression roller blocks 191, which vertically slide in companion parallel block slots 192, as illustrated in FIG. 26. The cartons 7 finally clear the upper stacker belt 254 at the rear cylinders 266, which operate to raise and lower the rear end of the upper stacker frame 226 and prevent crushing of the respective completed cartons 7** in the final lapped configuration, as heretofore described.

Referring again to FIGS. 1, 2 and 30 of the drawings, it will be appreciated that while the feed belt drive motor 78 in the feed module 2 is proportionally synchronized with the respective upper carriage motors 98 and lower carriage motors 126 in the respective fold/-prefold module 140, fold module 152, final fold module 156 and delivery module 201, the feed belt drive motor is electronically equipped to run at a speed which is slightly slower than the respective upper carriage motors 98 and lower carriage motors 126. This design facilitates proper spacing in the unfolded cartons 7 as they are bottom-fed through the feeder module 2 and this spacing is maintained at all times during passage of the cartons 7 throughout the fold/prefold module 140, fold module 152, final fold module 156 and delivery module 201. Furthermore, as further illustrated in FIG. 30, one of the upper carriage motors 98 or lower carriage motors 126 is selected for wiring as the "master" (M) drive motor for synchronizing the remaining "slave" (S) upper carriage motors 98, lower carriage motors 126 and feed belt drive motor 78, respectively. The lower carriage motor 126 located in the fold/-prefold module 140 is so designated by the letter "M" in the diagram in FIG. 30. This "master-slave" synchronous wiring and electronic system is located along with the respective operating control system for the carton folding apparatus 1, in the respective electrical control cabinets 194, illustrated in the drawings and detailed in FIG. 29. Wiring (not illustrated) for energizing the respective feed belt drive motor 78, upper carriage motors 98, lower carriage motors 126, upper stacker belt drive motor 258 and lower stacker belt drive motor 274 is channeled through the respective upper wire ways 119 and lower wire ways 123, illustrated in FIGS. 13 and 24, respectively.

Referring now to FIGS. 1, 6, 12, 13, 17 and 24 of the drawings, since the respective feed belts 68, upper carriage belts 105 and lower carriage belts 133 are only looped around the feed belt drum 87, upper carriage belt drive pulley 100 and lower carriage belt drive pulley 128, respectively, by operation of the feed belt idler rollers 82, upper belt idler rollers 102 and lower belt idler rollers 130, respectively, they can be quickly and easily removed and replaced without costly downtime occasioned by the necessary disassembly of conventional belt-support and transfer parts.

It will be appreciated that the air pressure required to operate the respective air cylinders may be supplied from a common source or several sources, as desired, and the air supply lines, fittings and controls are omitted from the drawings for brevity, the function and operation of which are well known to those skilled in the art.

While the preferred mode of operation for the respective modular carton folding apparatus 1 is synchronous driving of the belts by the respective feed belt drive motor 78, upper carriage motors 98 and lower carriage motors 126 according to the synchronous system described above, it will be appreciated by those skilled in the art that alternative drive systems may also be employed. For example, and in non-exclusive particular, a separate set of drive motors arranged as illustrated in the drawings may be employed to drive sets of common longitudinal drive shafts (not illustrated) for orchestrated operation of the respective belt systems at the required common, uniform speed.

While the preferred embodiments of the invention are detailed above, it will be appreciated that other embodiments may be incorporated therein without departing from the spirit and scope of the invention.

Having described our invention with the particularity set forth above, what is claimed is:

1. A carton folding apparatus comprising a feed module for receiving and delivering unfolded cartons, said feed module comprising spaced first support means; a pair of first vertical guide means slidably carried by said first support means in substantially vertical relationship, respectively; first upper horizontal guide means connecting said first vertical guide means in substantially horizontal relationship; upper feed assembly means mounted on said first upper horizontal guide means in slidably adjustable relationship for aligning the leading edges of the cartons in feeding relationship and guiding the cartons through said feed module; a pair of first vertical adjusting means engaging said first vertical guide means for selectively raising and lowering said first vertical guide means, respectively, said first upper horizontal guide means and said upper feed assembly means in concert; first lower horizontal guide means connecting said first support means in substantially horizontal relationship, a plurality of feed belt roller frame means disposed on said first lower horizontal guide means in spaced, parallel, slidably adjustable relationship and a plurality of endless feed belts carried by said feed belt roller frame means, respectively, for supporting the unfolded cartons;

a feed belt drive motor carried by one of said first support means, a feed belt drum rotatably carried by said first support means in spaced, parallel relationship with respect to said lower horizontal guide means, said feed belt drum receiving said feed belts in non-encircling, driving relationship, and connecting means connecting said feed belt drive motor to said feed belt drum for rotating said feed belt drum and driving said feed belts on said feed belt roller frame means in concert at said selected speed and to feed said cartons through said feed module in linear, spaced relationship; and at least one carton folding module positioned in unconnected alignment with said feed module, said carton folding module having independently driven, synchronized upper belt means and lower belt means for receiving the unfolded cartons from said feed module and folding the cartons in a selected configuration.

2. The carton folding apparatus of claim 1 wherein said upper feed assembly means further comprises parallel sets of upper rollers carried by said first upper horizontal guide means in spaced, slidably adjustable relationship; a pair of elongated feed gates carried by said sets of upper rollers, respectively, in spaced, slidably adjustable relationship; and a pair of carton guides carried by said first upper horizontal guide means in spaced, slidably adjustable relationship on each side of said feed gates, respectively, for receiving and aligning cartons of selected size in said feed module.

3. The carton folding apparatus of claim 2 wherein said lower feed assembly means further comprises first lower horizontal guide means connecting said first support means in substantially horizontal relationship and at least two feed belt means carried by said first lower horizontal guide means in slidably adjustable relationship for supporting the unfolded cartons and wherein said drive means is disposed between said first support means and engages said feed belt means for driving said feed belt means at a selected speed.

4. The carton folding apparatus of claim 3 wherein said at least two feed belt means further comprises a plurality of feed belt roller frame means disposed on said first lower horizontal guide means in spaced, parallel, slidably adjustable relationship and a plurality of endless feed belts carried by said feed belt roller frame means, respectively, and said drive means further comprises a feed belt drive motor carried by one of said support means, a feed belt drum rotatably carried by said support means in spaced, parallel relationship with respect to said lower horizontal guide means, said feed belt drum receiving said feed belts in non-encircling, driving relationship, and connecting means connecting said feed belt drive motor to said feed belt drum for rotating said feed belt drum and driving said feed belts on said feed belt roller frame means in concert at said selected speed.

5. The carton folding apparatus of claim 1 wherein said at least one carton folding module further comprises a prefold/fold module provided in unconnected, carton-receiving alignment with said feed module for receiving the unfolded cartons from said feed module and folding first selected carton panels in the cartons, and at least one fold module provided in unconnected, carton-receiving alignment with said prefold/fold module for receiving the partially folded cartons and folding and gluing said first selected carton panels and second selected carton panels in the cartons.

6. The carton folding apparatus of claim 5 wherein said lower feed assembly means further comprises first lower horizontal guide means connecting said first support means in substantially horizontal relationship and at least two feed belt means carried by said first lower horizontal guide means in slidably adjustable relationship for supporting the unfolded cartons and said drive means is disposed between said first support means and engages said feed belt means for driving said feed belt means at a selected speed.

7. The carton folding apparatus of claim 6 wherein:

(a) said at least two feed belt means further comprises a plurality of feed belt roller frame means disposed on said first lower horizontal guide means in spaced, parallel, slidably adjustable relationship and a plurality of endless feed belts carried by said feed belt roller frame means, respectively, and said drive means further comprises a feed belt drive motor carried by one of said support means, a feed belt drum rotatably carried by said support means in spaced, parallel relationship with respect to said lower horizontal guide means, said feed belt drum receiving said feed belts in non-encircling, driving relationship, and connecting means connecting said feed belt drive motor to said feed belt drum for rotating said feed belt drum and driving said feed belts on said feed belt roller frame means in concert at a selected speed.

(b) said upper feed assembly means further comprises parallel sets of upper rollers carried by said first upper horizontal guide means in spaced, slidably adjustable relationship; a pair of elongated feed gates carried by said sets of upper rollers, respectively, in spaced, slidably adjustable relationship, and a pair of carton guides carried by said first upper horizontal guide means in spaced, slidably adjustable relationship; and a pair of carton guides carried by said first upper horizontal guide means in spaced, slidably adjustable relationship on each side of said feed gates, respectively, for receiving and aligning cartons of selected size in said feed module.

8. The carton folding apparatus of claim 1 further comprising at least two idler rollers provided in rotatable relationship on each of said belt roller frame means below the longitudinal axis of said feed belt drum for receiving said endless feed belts, respectively, and guiding said endless feed belts over said feed belt drum in said non-encircling, driving relationship, respectively.

9. The carton folding apparatus of claim 8 wherein said upper feed assembly means further comprises parallel sets of upper rollers carried by said first upper horizontal guide means in spaced, slidably adjustable relationship; a pair of elongated feed gates carried by said sets of upper rollers, respectively, in spaced, slidably adjustable relationship, and a pair of carton guides carried by said first upper horizontal guide means in spaced, slidably adjustable relationship on each side of said feed gates, respectively, for receiving and aligning cartons of selected size in said feed module.

10. The carton folding apparatus of claim 9 wherein said at least one carton folding module further comprises a prefold/fold module provided in unconnected, carton-receiving alignment with said feed module for receiving the unfolded cartons from said feed module and folding first selected carton panels in the cartons and at least one fold module provided in unconnected, carton-receiving alignment with said prefold/fold module for receiving the partially folded cartons and folding and gluing said first selected carton panels and second selected carton panels in the cartons.

11. The carton folding apparatus of claim 10 further comprising a stacker unit provided in unconnected, carton-receiving alignment with said fold module for receiving the folded and glued cartons and stacking the cartons in lapped relationship.

12. The carton folding apparatus of claim 11 wherein said stacker unit further comprises a lower stacker frame; a lower stacker endless belt rotatably disposed in said lower stacker frame; lower stacker drive means carried by said lower stacker frame and engaging said lower stacker endless belt in driving relationship; an upper stacker frame mounted on said lower stacker frame; an upper stacker endless belt rotatably disposed in said upper stacker frame substantially parallel to said lower stacker endless belt; upper stacker drive means carried by said upper stacker frame and engaging said upper stacker endless belt in driving relationship; nip roller means disposed beneath the top loop of said lower stacker endless belt; and nip roller pneumatic cylinder means carried by said upper stacker frame and engaging said nip roller means in selectively retracting and extending relationship, whereby said top loop of said lower stacker endless belt is tensioned to create a "nip" of selected magnitude between said lower stacker endless belt and said upper stacker endless belt responsive to operation of said nip roller pneumatic cylinder means, for receiving and stacking the cartons.

13. The carton folding apparatus of claim 12 further comprising a plurality of vertical roller block slots provided in oppositely-disposed, parallel relationship in said upper stacker frame; a plurality of roller block means slidably disposed in said roller block slots, respectively; and a plurality of top-yielding compression roller means carried by oppositely-disposed sets of said roller block means, said top yielding compression roller means engaging the bottom loop of said upper stacker endless belt and biasing said bottom loop of said upper stacker endless belt in yielding relationship against the lapped cartons disposed between said upper stacker endless belt and said lower stacker endless belt.

14. The carton folding apparatus of claim 12 further comprising upper stacker belt tensioning roller means disposed beneath the top loop of said upper stacker endless belt and upper stacker belt tensioning cylinder means carried by said upper stacker frame and engaging said upper stacker belt tensioning roller means in selectively retracting and extending relationship, whereby said upper stacker endless belt is selectively tensioned responsive to operation of said upper stacker belt tensioning cylinder means.

15. The carton folding apparatus of claim 12 further comprising:

(a) a plurality of vertical roller block slots provided in oppositely-disposed, parallel relationship in said upper stacker frame; a plurality of roller block means slidably disposed in said roller block slots, respectively; and a plurality of top-yielding compression roller means carried by oppositely-disposed sets of said roller block means, said top yielding compression roller means engaging the bottom loop of said upper stacker endless belt in yielding relationship and biasing said bottom loop of said upper stacker endless belt against the lapped cartons disposed between said upper stacker endless belt and said lower stacker endless belt; and (b) upper stacker belt tensioning roller means disposed beneath the top loop of said upper stacker endless belt and upper stacker belt tensioning cylinder means carried by said upper stacker frame and engaging said upper stacker belt tensioning roller in selectively retracting and extending relationship, whereby said upper stacker endless belt is selectively tensioned responsive to operation of said upper stacker belt tensioning cylinder means.

16. The carton folding apparatus of claim 12 further comprising a pair of rear cylinder means engaging said upper stacker frame for exerting an upward force of selected magnitude on said upper stacker frame and relieving the pressure on the cartons disposed between said upper stacker endless belt and said lower stacker endless belt.

17. The carton folding apparatus of claim 12 further comprising:

(a) a plurality of vertical roller block slots provided in oppositely-disposed, parallel relationship in said upper stacker frame; a plurality of roller block means slidably disposed in said roller block slots, respectively; and a plurality of top-yielding compression roller means carried by oppositely-disposed sets of said roller block means, said top yielding compression roller means engaging the bottom loop of said upper stacker endless belt in yielding relationship and biasing said bottom loop of said upper stacker endless belt against the lapped cartons disposed between said upper stacker endless belt and said lower stacker endless belt;

(b) upper stacker belt tensioning roller means disposed beneath the top loop of said upper stacker endless belt and upper stacker belt tensioning cylinder means carried by said upper stacker frame and engaging said upper stacker belt tensioning roller in selectively retracting and extending relationship, whereby said upper stacker endless belt is selectively tensioned responsive to operation of said upper stacker belt tensioning cylinder means; and (c) a pair of rear cylinder means engaging said upper stacker frame for exerting an upward force of selected magnitude on said upper stacker frame and relieving the pressure on the cartons disposed between said upper stacker endless belt and said lower stacker endless belt.

18. The carton folding apparatus of claim 12 wherein said prefold/fold module and said at least one carton feed module further comprises spaced second support means; second vertical guide means slidably carried by each of said second support means, respectively, in substantially vertical relationship; second upper horizontal guide means connecting said second vertical guide means in substantially horizontal relationship; a pair of upper carriage means slidably disposed on said second upper horizontal guide means in facing, adjustable relationship; a pair of second vertical adjusting means carried by said second support means, respectively, and engaging said second vertical guide means, respectively, for selectively raising and lowering said second vertical guide means, said second upper horizontal guide means and said upper carriage means in said concert said upper belt means comprises; a pair of upper carriage belts carried by said upper carriage means, respectively; second lower horizontal guide means connecting said second support means in substantially horizontal relationship; a pair of lower carriage means slidably disposed on said second lower horizontal guide means in facing, adjustable relationship said lower belt means comprises; a pair of lower carriage belts carried by said lower carriage means, respectively; a pair of upper carriage drive means engaging said pair of upper carriage belts, respectively, for driving said upper carriage belts at a second selected speed; and a pair of lower carriage drive means engaging said pair of lower carriage belts for driving said lower carriage belts at said second selected speed, whereby the cartons are received from said feed module between parallel sets of said upper carriage belts and said lower carriage belts and and the cartons are caused to traverse said carton folding module responsive to synchronous operation of said upper carriage drive means, and said lower carriage drive means respectively.

19. The carton folding apparatus of claim 18 wherein:

(a) said upper carriage means each further includes an upper carriage roller assembly characterized by a pair of parallel, elongated upper roller assembly frames, a plurality of upper carriage rollers carried by each of said upper roller assembly frames and wherein said upper carriage belts engage said upper carriage rollers and said upper carriage drive means in upper belt-driving relationship, respectively; and (b) said lower carriage means further includes a lower carriage roller assembly characterized by a pair of parallel, elongated lower roller assembly frames, a plurality of lower carriage rollers carried by each of said lower roller assembly frames and wherein said lower carriage belts engage said lower carriage rollers and said lower carriage drive means in lower belt-driving relationship, respectively.

20. The carton folding apparatus of claim 19 further comprises a plurality of vertical roller block slots provided in oppositely-disposed, parallel relationship in said upper stacker frame; a plurality of roller block means slidably disposed in said roller block slots, respectively; and a plurality of top-yielding compression roller means carried by oppositely-disposed sets of said roller block means, said top yielding compression roller means engaging the bottom loop of said upper stacker endless belt and biasing said bottom loop of said upper stacker endless belt in yielding relationship against the lapped cartons disposed between said upper stacker endless belt and said lower stacker endless belt.

21. The carton folding apparatus of claim 20 further comprising upper stacker belt tensioning roller means disposed beneath the top loop of said upper stacker endless belt and upper stacker belt tensioning cylinder means carried by said upper stacker frame and engaging said upper stacker belt tensioning roller means in selectively retracting and extending relationship, whereby said upper stacker endless belt is selectively tensioned responsive to operation of said upper stacker belt tensioning cylinder means.

22. The carton folding apparatus of claim 21 further comprising a pair of rear cylinder means engaging said upper stacker frame for exerting an upward force of selected magnitude on said upper stacker frame and relieving the pressure on the cartons disposed between said upper stacker endless belt and said lower stacker endless belt.

23. The carton folding apparatus of claim 1 wherein said at least one carton folding module further comprises spaced second support means; second vertical guide means slidably carried by each of said second support means, respectively, in substantially vertical relationship; second upper horizontal guide means connecting said second vertical guide means in substantially horizontal relationship; a pair of upper carriage means slidably disposed on said second upper horizontal guide means in facing, adjustable relationship; a pair of second vertical adjusting means carried by said second support means, respectively, and engaging said second vertical guide means, respectively, for selectively raising and lowering said second vertical guide means, said second upper horizontal guide means and said upper carriage means in concert said upper belt means comprises; a pair of upper carriage belts carried by said upper carriage means, respectively; second lower horizontal guide means connecting said second support means in substantially horizontal relationship said lower belt means comprises; a pair of lower carriage means slidably disposed on said second lower horizontal guide means in facing, adjustable relationship; a pair of lower carriage belts carried by said lower carriage means, respectively; a pair of upper carriage drive means engaging said pair of upper carriage belts, respectively, for driving said upper carriage belts at a second selected speed; and a pair of lower carriage drive means engaging said pair of lower carriage belts for driving said lower carriage belts at said second selected speed, whereby the cartons are received from said feed module between parallel sets of said upper carriage belts and said lower carriage belts and and the cartons are caused to traverse said carton folding module responsive to synchronous operation of said upper carriage drive means, and said lower carriage drive means respectively.

24. The carton folding apparatus of claim 23 wherein said upper carriage means each further includes an upper carriage roller assembly characterized by a pair of parallel, elongated upper roller assembly frames, a plurality of upper carriage rollers carried by each of said upper roller assembly frames and wherein said upper carriage belts engage said upper carriage rollers and said upper carriage drive means in upper belt-driving relationship, respectively.

25. The carton folding apparatus of claim 23 wherein said lower carriage means further includes a lower carriage roller assembly characterized by a pair of parallel, elongated lower roller assembly frames, a plurality of lower carriage rollers carried by each of said lower roller assembly frames and wherein said lower carriage belts engage said lower carriage rollers and said lower carriage drive means in lower belt-driving relationship, respectively.

26. The folding apparatus of claim 23 wherein:

(a) said upper carriage means each further includes an upper carriage roller assembly characterized by a pair of parallel, elongated upper roller assembly frames, a plurality of upper carriage rollers carried by each of said upper roller assembly frames and wherein said upper carriage belts engage said upper carriage rollers and said upper carriage drive means in upper belt-driving relationship, respectively; and (b) said lower carriage means further includes a lower carriage roller assembly characterized by a pair of parallel, elongated lower roller assembly frames, a plurality of lower carriage rollers carried by each of said lower roller assembly frames and wherein said lower carriage belts engage said lower carriage rollers and said lower carriage drive means in lower belt-driving relationship, respectively.

27. The carton folding apparatus of claim 26 further comprising at least two idler rollers provided in rotatable relationship on each of said belt roller frame means for receiving said endless feed belts, respectively, and guiding said endless feed belts over said feed belt drum in said non-encircling, driving relationship.

28. The carton folding apparatus of claim 27 wherein said at least one carton folding module further comprises a prefold/fold module provided in unconnected, carton-receiving alignment with said feed module for receiving the unfolded cartons from said feed module and folding first selected carton panels in the cartons and at least one fold module provided in unconnected, carton-receiving alignment with said prefold/fold module for receiving the partially folded cartons and folding and gluing said first selected carton panels and second selected carton panels in the cartons.

29. A carton folding apparatus comprising:

(a) a feed module for receiving and delivering unfolded cartons, said feed module comprising spaced, upward-standing first supports, a pair of first vertical guide means slidably carried by each of said first supports in substantially vertical relationship, respectively; a pair of first upper horizontal guide means connecting said first vertical guide means in spaced, substantially horizontal relationship; upper feed assembly means mounted on said first upper horizontal guide means in slidably adjustable relationship for aligning the leading edges of the cartons in feeding relationship and guiding the cartons through said feed module; a pair of first vertical pneumatic cylinder means engaging said first vertical guide means, respectively, for selectively raising and lowering said first vertical guide means, respectively, said first upper horizontal guide means and said upper feed assembly means in concert; lower feed assembly means disposed beneath said upper feed assembly means for supporting said cartons; feed drive means engaging said lower feed assembly means for feeding said cartons through said feed module in linear, spaced relationship;

(b) at least one carton folding module positioned in unconnected alignment with said feed module for receiving the unfolded cartons from said feed module and folding the cartons in a selected configuration, said at least one carton folding module further comprising spaced second, upward-standing supports; a pair of second vertical guide means slidably carried by each of said second supports in substantially vertical relationship respectively; a pair of second upper horizontal guide means connecting said second vertical guide means in spaced, substantially horizontal relationship; first upper carriage means and second upper carriage means slidably disposed on said second upper horizontal guide means in facing, horizontally-adjustable relationship; a pair of second vertical adjusting pneumatic cylinder means carried by said second support means, respectively, and engaging said second vertical guide means, respectively, for selectively raising and lowering said second vertical guide means, said second upper horizontal guide means and said first upper carriage means and said second upper carriage means in concert; first upper carriage belt means carried by said first upper carriage means and second upper carriage belt means carried by said second upper carriage means; a pair of second lower horizontal guide means connecting said second support means in spaced, substantially horizontal relationship; first lower carriage means and second lower carriage means slidably disposed on said second lower horizontal guide means in facing, horizontally-adjustable relationship; first lower carriage belt means carried by said first lower carriage means, and second lower carriage belt means carried by said second lower carriage means, respectively; a pair of upper carriage drive means carried by said first upper carriage means and said second upper carriage means, respectively, said upper carriage drive means engaging and driving said first upper carriage belt means and said second upper carriage belt means, respectively, in concert at a second selected speed; and a pair of lower carriage drive means carried by said first lower carriage means and said second lower carriage means, respectively, and engaging and driving said first lower carriage belt means and said second lower carriage belt means, respectively, at said second selected speed, whereby the cartons are received from said feed module between parallel sets of a first pair of said first upper carriage belt means and said first lower carriage belt means and a second pair of said second upper carriage belt means and said second lower carriage belt means and the cartons are caused to traverse said carton folding module responsive to synchronous operation of said upper carriage drive means and said lower carriage drive means, respectively; and (c) a stacker unit provided in unconnected, carton-receiving alignment with said fold module for receiving the folded and glued cartons and stacking the cartons in lapped relationship.

30. The carton folding apparatus of claim 29 wherein said upper carriage means each further comprises an upper carriage roller assembly characterized by a pair of parallel, elongated upper roller assembly frames, a plurality of upper carriage rollers carried by each of said upper roller assembly frames and wherein said upper carriage belt means engage said upper carriage rollers and said upper carriage drive means in upper belt-driving relationship, respectively.

31. The carton folding apparatus of claim 30 wherein said lower carriage means each further comprises a lower carriage means further includes a lower carriage roller assembly characterized by a pair of parallel, elongated lower roller assembly frames, a plurality of lower carriage rollers carried by each of said lower roller assembly frames and wherein said lower carriage belt means engage said lower carriage rollers and said lower carriage drive means in lower belt-driving relationship, respectively.

32. The carton folding apparatus of claim 31 wherein said at least one carton folding apparatus further comprises a fold/prefold aligned with said feed module for receiving cartons from said feed module; a fold module aligned with said fold/prefold module for receiving cartons from said fold/prefold module; a final fold module aligned with said fold module for receiving cartons from said fold module; and a delivery module aligned with said final fold module for receiving cartons from said final fold module and delivering cartons to said stacker units.

* * * * *